US006268032B1

(12) United States Patent
Mertens et al.

(10) Patent No.: US 6,268,032 B1
(45) **Date of Patent: *Jul. 31, 2001**

(54) REPOSITIONABLE NOTE SHEETS AND METHOD OF FORMATION THEREOF

(75) Inventors: Timothy A. Mertens; Alden R. Miles, both of St. Paul; Mark S. Vogel, Maplewood; Gregory F. Stifter, Woodbury; Kim K. Tsujimoto, New Brighton, all of MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/943,634

(22) Filed: Oct. 3, 1997

(51) Int. Cl.[7] ..... G09F 3/00

(52) U.S. Cl. ..... 428/40.1; 283/81; 428/41.6; 428/41.7; 428/41.8; 428/42.1; 428/42.2; 428/42.3; 428/43; 428/192; 428/194; 428/906

(58) Field of Search ..... 156/184, 191, 156/250, 259, 270, 271, 277, 248, 289, 291; 427/208.6; 428/40.1, 41.6, 41.7, 41.8, 42.1, 42.2, 42.3, 43, 192, 194, 906; 283/81

(56) References Cited

U.S. PATENT DOCUMENTS

| | | | | |
|---|---|---|---|---|
| 2,170,147 | | 8/1939 | Lane | 206/56 |
| 2,391,539 | * | 12/1945 | Avery . | |
| 2,830,003 | * | 4/1958 | Mason . | |
| 2,880,862 | * | 4/1959 | Sermattei . | |
| 4,457,981 | * | 7/1984 | Jenkins | 156/291 X |
| 4,661,189 | * | 4/1987 | Voy et al. | 156/277 X |
| 4,690,720 | * | 9/1987 | Mack | 156/277 X |
| 4,725,454 | * | 2/1988 | Galli et al. | 427/208.6 X |
| 4,842,303 | | 6/1989 | Molenda | 281/38 |
| 4,883,553 | * | 11/1989 | David et al. | 156/193 |

(List continued on next page.)

FOREIGN PATENT DOCUMENTS

| | | |
|---|---|---|
| 0 081 963 | 6/1983 | (EP) . |
| 0 220 707 | 5/1987 | (EP) . |
| 0 370 642 | 5/1990 | (EP) . |
| WO 94/14614 | 7/1994 | (WO) . |

OTHER PUBLICATIONS

Brochure entitled "Direct Response Products—We Make Your Message Stick," 3M Media Networks, 1995, 12 pp.
Brochure entitled "Direct Response—A Direct Line to Your Prospects," 3M Media Networks, 1992, 22 pp.

*Primary Examiner*—Nasser Ahmad
(74) *Attorney, Agent, or Firm*—Michaele A. Hakama

(57) ABSTRACT

A web of sheet material has a plurality of longitudinal rows of indicia patterns printed on a front face thereon, with the indicia patterns all aligned on the web in common readability orientation. On its back face, the web has a plurality of longitudinally disposed patterns of repositionable pressure sensitive adhesive thereon, with the adhesive patterns being oriented in registration with the rows of indicia patterns. Longitudinal severing of the web thus results in a plurality of identical web strips. Lateral severing of the web strips results in a plurality of identical note sheets, each note sheet bearing one of the indicia patterns on its front face and a pattern of repositionable pressure sensitive adhesive on its back face. The note sheets are applied in registration to an advertising piece to create a promotional assembly. In this process, unique intermediate rolls of the web and web strips are developed. The web strips are provided in linerless form, or may be carried on a liner sheet for further processing and application to an advertising piece.

24 Claims, 18 Drawing Sheets

U.S. PATENT DOCUMENTS 4,886,680 * 12/1989 Tindall .
4,889,234 12/1989 Sorensen et al. ..... 206/459
4,907,825 3/1990 Miles et al. ..... 281/51
5,017,257 * 5/1991 Murphy ..... 156/270 X
5,154,962 * 10/1992 Mertens et al. .
5,283,091 2/1994 Darvell et al. ..... 428/40
5,340,629 * 8/1994 Rodighiero .
5,382,055 1/1995 Mertens et al. ..... 283/67
5,405,475 * 4/1995 Kraft et al. ..... 156/277 X
5,429,850 * 7/1995 Held ..... 156/291 X
5,462,488 10/1995 McKillip ..... 462/26
5,474,248 * 12/1995 Bradshaw et al. .
5,476,698 12/1995 Denny ..... 428/40
5,484,499 * 1/1996 Marschke ..... 156/193
5,618,062 4/1997 Mertens et al. ..... 283/67
5,725,719 * 3/1998 Szczepaniec et al. .
5,766,401 * 6/1998 Campbell et al. ..... 156/277

* cited by examiner

REPOSITIONABLE NOTE SHEETS AND METHOD OF FORMATION THEREOF

BACKGROUND OF THE INVENTION

Magazines, catalogs, newspapers and direct-mail pieces are all well known methods to communicate specific information to readers. The information frequently takes the form of advertisements which are designed to capture the reader's attention and elicit a response for the advertiser. Such advertisements can take the form of an individual printed sheet (e.g., a letter for mailing) or printing on wide webs, which are subsequently folded and cut to form advertising "signatures." Other advertising is accomplished by direct mail, where a printed piece is processed through mail-handling equipment. The key aspect in each instance is that the advertisement capture the reader's attention for the product or service being promoted, and that the image or message conveyed by the advertisement make an impression on the reader which, alone or in aggregation, leads the reader to purchase the goods or services being promoted.

In general, printing is controlled by the "registration" of various ink stations with a known location on the substrate to which the ink is applied. Registration can be "hairline" (0.1 mm or less variation between ink printed in different stations), "normal" (1 to 5 mm variation) or "loose" (5 to 25 mm variation). In forming an advertising signature, the printed substrate is folded to provide a "registration edge," the registration edge is a folded edge which is in a predetermined ("registered") location with respect to the printing, and is used in subsequent processing steps for the printed piece. A printed, folded piece may form a "signature," which is a booklet formed from the web and used to form a larger book.

Direct-mail advertising may take the form of printed material formed from either sheets or from a continuous web. In some instances, the printed material is further inserted into an envelope prior to further processing of the direct-mail piece by mail-handling equipment. Such mail-handling equipment may consist of high-speed movement of the direct-mail pieces by rapidly moving belts. Consequently, the United States Postal Service requires that any label applied to the exterior of a direct-mail piece have an adhesive coating along all sides of the label, so that the adhesive securely anchors the label from being spontaneously removed by the friction belts during processing of the direct-mail piece.

Advertising signatures are commonly used to form magazines and catalogs. An advertising signature is an insert that is placed in the magazine and comprises a plurality of pages (typically rectangular pieces of paper having advertising printed thereon) which are folded over to form a registration edge. Multiple signatures are typically joined together on a binding line along their respective registration edges. Separate signatures are grouped together by precisely aligning them on at least two edges. A group of signatures is bound together (for instance, by glue or staples) and typically trimmed to final form. High quality books are formed by holding very close registration between the printing and all assembly and converting operations.

One method of enhancing an advertisement and increasing reader response is to attach a pressure sensitive label or sheet of paper carrying a repositionable adhesive on the advertisement. The most popular of these repositionable products is a repositionable sheet, such as the Post-it® brand notes sold by Minnesota Mining and Manufacturing Company of St. Paul, Minn. Such sheets in familiar form are available in stacks or pads of sheets, one adhered to another. Such repositionable sheets have a first side which is partially coated with a repositionable pressure sensitive adhesive (RPSA) and a second side which is either plain (no printing) for writing a note, or which may have a preprinted message or design thereon. Advertising signatures have been provided with repositionable sheets that contain information such as the name and telephone number of the advertiser or a coupon for a price discount. The sheets are repositionable so that they can be removed from the advertising signature and adhered at another location (for example, a desk or refrigerator) to remind the reader to call the advertiser or to use as a coupon at a later date.

Typical labels are constructed from a backing, such as paper, carrying indicia on one major surface and a layer of pressure sensitive adhesive entirely covering the other major surface. This backing is then attached to a "release liner" which usually is formed from paper and is coated with a thin layer of an adhesive release material, such as cross-linked silicone polymer.

Labels are very efficient to produce in large or small numbers. Wide rolls of backing are coated with a pressure sensitive adhesive and a release liner of similar width is wound along with the backing. In this way, the adhesive is protected, and the backing is not damaged by contact with the adhesive (for instance, by adhesive transferring to the backing or delaminating the backing when subsequently unwound). This laminate assembly (backing and release liner) may be unwound, printed, die cut, split into smaller widths and re-wound into rolls. Because the label is fully covered with adhesive, graphics printed thereon can take any orientation without any regard to registering the graphics to adhesive location.

Common labeling equipment provides for a location to support such a smaller width roll for application, means to advance the web wound on the roll, means to detect each discrete label as it is advanced, means to separate the label from the liner (e.g., a peeler bar), and means for attaching the label to an underlying surface of a workpiece (e.g., a container, direct-mail piece, etc.). Typically, the labeling equipment detects a label by sensing a difference in the reflective properties of the label and its supporting liner material. When such a difference is detected, the labeling equipment controls the registered placement of the label on the workpiece. The liner, which previously supported the label, often is re-wound on a take-up reel and subsequently discarded as waste.

As noted above, repositionable pressure-sensitive sheets in the form of 3M brand Post-it® notes have been attached to printed pieces. Illustrative examples are included in Pusateri et al. U.S. patent application Ser. No. 08/095,722 and Miles et al. U.S. patent application Ser. No. 08/729,780, both commonly owned by the assignee of the instant application, Minnesota Mining and Manufacturing Company, St. Paul, Minn., and incorporated herein by reference.

Printed notes have been formed by partially coating a wide web with bands of RPSA in predetermined locations, splitting the web into small rolls, printing on the smaller rolls and further splitting them into yet smaller rolls. The rolls are split in the center of the adhesive bands to provide small rolls approximately 75 mm wide and 1000 meters long. These rolls carry indicia which serve as a "registration eyemark" for each note sheet formed therefrom. As the rolls are slit, each RPSA band is slit in two to eventually form the top adhesive portion of the note sheets formed from that roll.

Because the graphics printed on the web are always oriented with respect to the RPSA band, half the small rolls must be re-wound to orient all the graphics in a same direction on every small roll. This step adds costs, delays the attachment and adds another step in completing the finished printed piece. In addition, small amounts of adhesive gradually accumulate on the web slitting knives and along one of the edges of each small roll. This adhesive build-up requires the splitting process to be periodically stopped to clean the web slitting knives, further adding cost and time delays to the process.

The small rolls are subsequently placed on another device adapted to receive such a small roll, unwind that roll, detect the registration eyemarks thereon, separate a note sheet from the small roll, and attach that note sheet to an underlying printed piece such as an advertising signature or direct-mail piece. When adhesive accumulates on the edge of the wound webs of the small rolls, the rolls attract dirt and diminish the appearance of the note sheets separated therefrom. Additionally, the lightly bound adhesive on the edges easily transfers from the edges to other surfaces, such as parts of the equipment used to separate the note sheet from the small roll and attach the note sheet to the workpiece. Ultimately, as the adhesive accumulates, the handling equipment will stop when the small roll catches on an adhesive mass and fails to feed properly, thereby "jamming" the machine.

One other means to provide a printed note sheet on a carrier sheet is disclosed in Crandall et al. U.S. patent application Ser. No. 08/636,615, commonly owned by the assignee of the instant application, Minnesota Mining and Manufacturing Company, St. Paul, Minn., and incorporated herein by reference. This disclosure shows a series of pressure-sensitive note sheets attached to a liner. Each pressure-sensitive note sheet includes a band of adhesive extending along two parallel terminal edges of the sheet. Adjacent bands are provided by splitting the web through a wider band of adhesive which had previously been applied thereto.

SUMMARY OF THE INVENTION

The present relates to the formation of an assembly which has a repositionable note sheet adhered thereto. One aspect of the invention is a method of making a plurality of identical rolls of printed sheet material from a continuous web of sheet material. The method includes applying a first plurality of longitudinal extending patterns of repositionable pressure sensitive adhesive to a back face of a continuous web of sheet material, with the adhesive patterns being identical and equally spaced apart laterally across the back face of the web. A plurality of longitudinal rows of indicia patterns are printed on a front face of the web of sheet material, with each indicia pattern having a common orientation for readability. Each row on the front face of the web is aligned opposite a respective one of the adhesive patterns on the back side of the web. The web is slit along a longitudinal web separation line between adjacent rows of indicia patterns to form a plurality of web strips. Each web strip is generally identical with respect to the relative registration orientations of the adhesive patterns and indicia patterns on opposite faces thereof. Each web strip is then wound into a roll. Web strips formed in this manner are then used to define the repositionable note sheets. The web strip may by linerless, or a liner sheet may be adhered thereto via the repositionable pressure sensitive adhesive on the web strip for further processing and handling. When linerless, eyemarks are printed on the web strip for registration purposes. When a liner sheet is employed, eyemarks are printed on the liner sheet.

In one aspect, the present invention is an improvement to a web of sheet material having a front major face and a back, opposite major face. The front face has a plurality of longitudinal rows of indicia patterns disposed thereon, each row having a longitudinal row top edge and a longitudinal row bottom edge, and each row being formed from a plurality of indicia patterns segments. Each pattern segment has a segment top edge coterminous with its respective top row edge and a segment bottom edge coterminous with its respective bottom row edge, and each pattern segment has a left side edge and a right side edge. The back face has a plurality of longitudinally disposed patterns of repositionable pressure sensitive adhesive thereof. Each adhesive pattern has a longitudinal adhesive top edge and a longitudinal adhesive bottom edge, with the adhesive top edge of each adhesive pattern being aligned adjacent and opposite to the row top edge of one of the rows of indicia patterns.

In another form, the present invention is a web strip assembly comprising a note sheet strip and a liner sheet strip. The note sheet strip has a front major face, a back, opposite major face, a longitudinally extending top edge and a longitudinally extending bottom edge. The front face thereof has a plurality of longitudinally aligned indicia patterns segments disposed thereon, with each pattern segment having a longitudinally extending segment top edge, a longitudinally extending segment bottom edge, a laterally disposed left side edge and a laterally disposed right side edge. The back face has a first longitudinally aligned pattern of repositionable pressure sensitive adhesive thereon. The first adhesive pattern has a longitudinal adhesive top edge and a longitudinal adhesive bottom edge, with the adhesive top edge being aligned adjacent and opposite to the segment top edges of the indicia pattern segments. The liner sheet strip has a first major face, a second, opposite major face, a longitudinally extending top edge and a longitudinally extending bottom edge. The first face of the liner sheet strip is laminated to the back face of the note sheet strip via the repositionable pressure sensitive adhesive thereon. The top edges of the note sheet strip and liner sheet strip are coterminous. Likewise, the bottom edges of the note sheet strip and liner sheet strip are coterminous.

While the above-identified drawing figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention. It should be specifically noted that the figures have not been drawn to scale as it has been necessary to enlarge certain portions for clarity.

DETAILED DESCRIPTION OF THE PREFERRED EMBODIMENTS

Background and Prior Linerless Web Strip Formation

In describing the preferred embodiments of the invention, specific terminology will be used for the sake of clarity. The invention, however, is not intended to be limited to the specific terms so selected, and it is to be understood that each term so selected includes all the technical equivalents that operate similarly.

Figure 1:
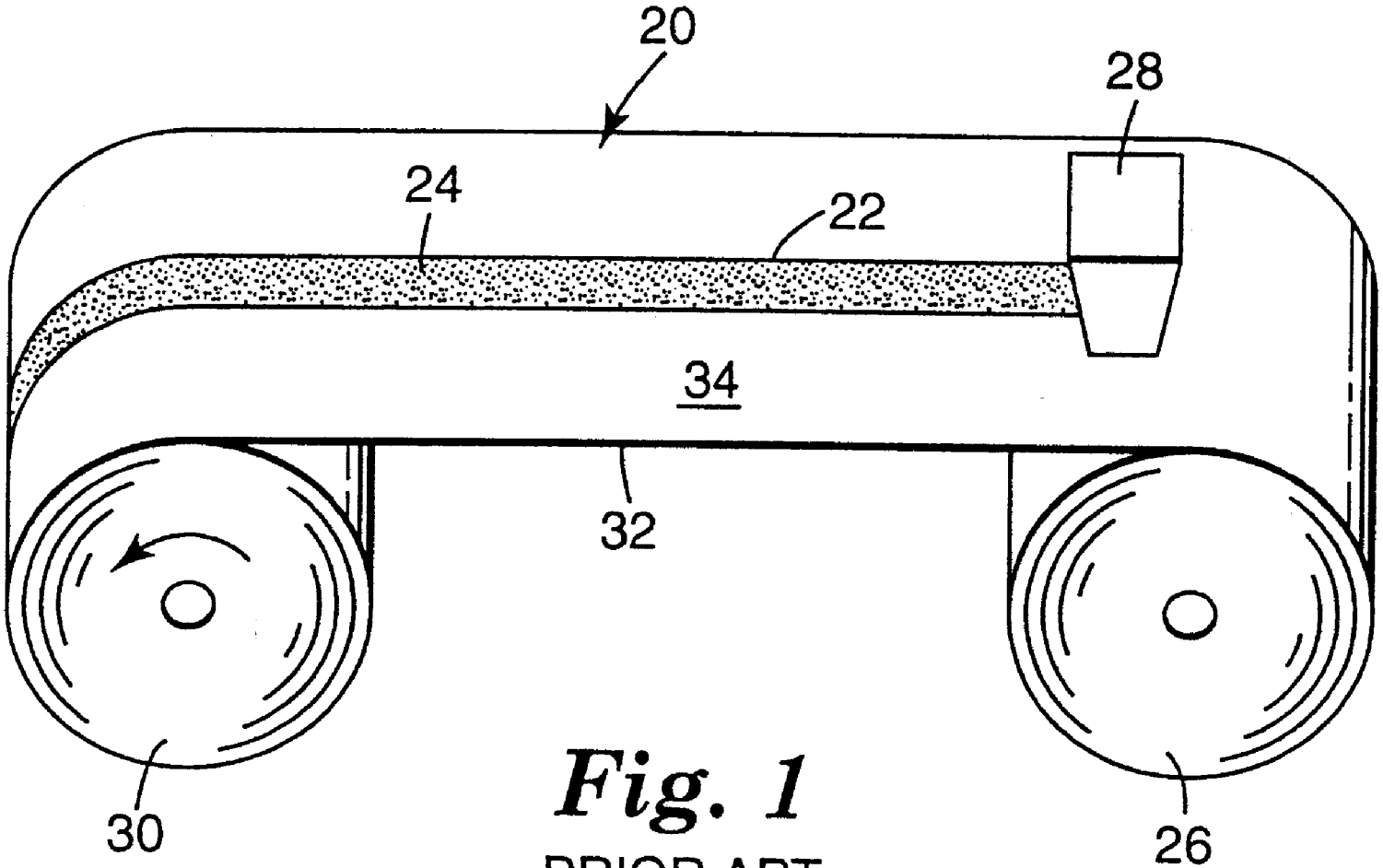
Fig. 1 PRIOR ART
FIG. 1 is a schematic representation of a portion of a prior art process for making rolls of adhesive printed note sheets.

FIG. 1 illustrates a conventional method for preparing a web 20 with a predetermined adhesive pattern, which in this example is illustrated as a band 22 of repositionable pressure-sensitive adhesive (RPSA) 24. A roll of sheet material 26 (such as paper or film (which may be opaque or transparent)) is unwound and the adhesive pattern applied thereto from an adhesive-coating apparatus 28 (e.g., a slot dye coater) and re-wound as web roll 30. Frequently, an adhesion promoting material (primer) and adhesive release material (release layer) are also applied to the web 20. The web 20 has a front major face 32 and an opposite, back major face 34. The adhesion promoting material or primer is applied to the back face 34 of the web 20 and then dried or cured. The RPSA 24 is then applied to the back face 34 over the primer. The adhesive release material or release layer is applied to the front face 32 of the web 20, so that the web 20 may be efficiently wound and unwound for subsequent processing (e.g., web roll 30).

Figure 2:
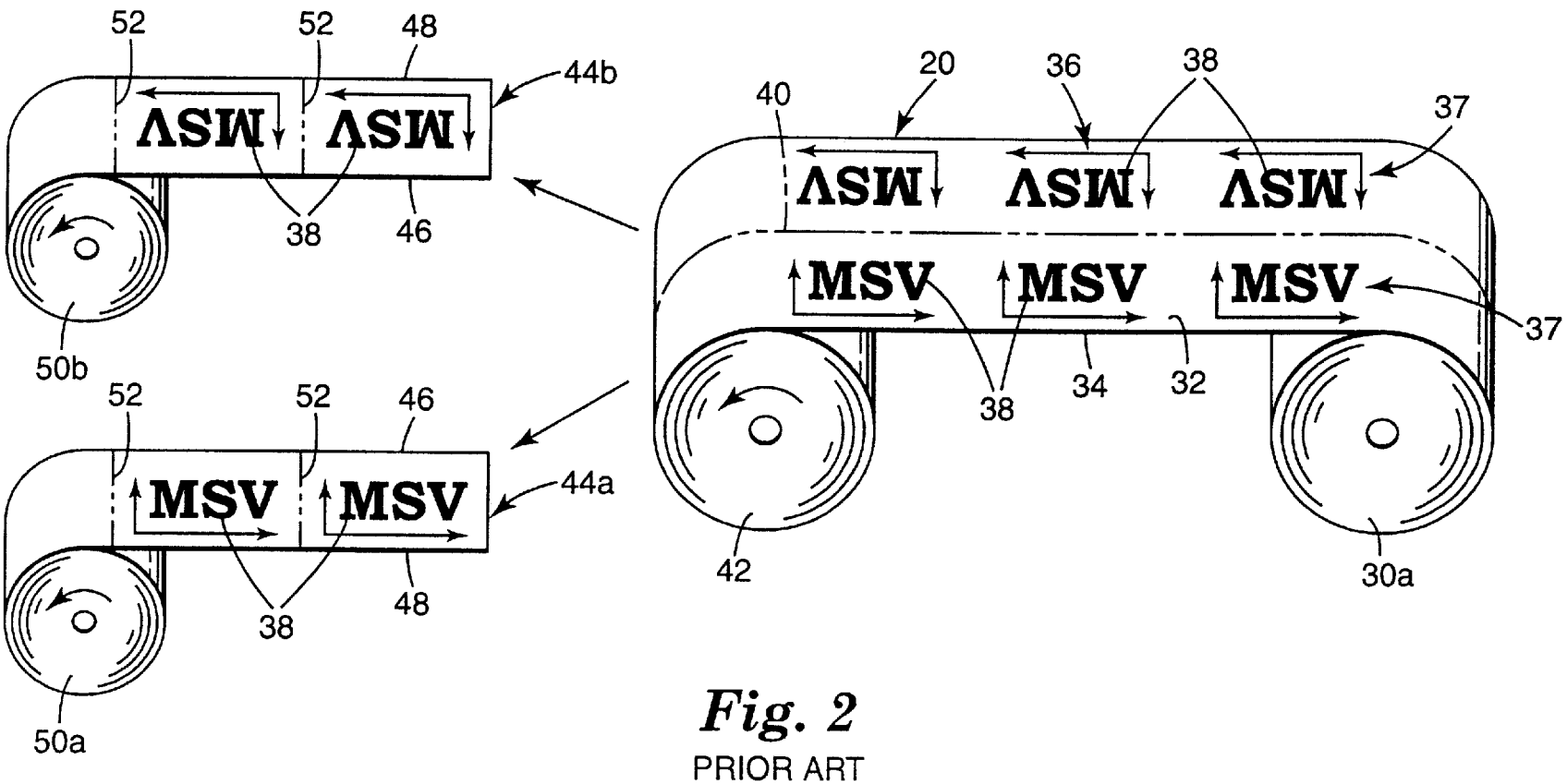
Fig. 2 PRIOR ART
FIG. 2 is a schematic illustration of additional steps in the prior art process of making adhesive printed note sheets.

FIG. 2 illustrates subsequent processing steps for the web 20. The web roll 30 formed in FIG. 1 has been re-wound so that the front face 32 thereof faces radially outward, as designated by web roll 30*a* in FIG. 2. A predetermined printing pattern 36 is applied to the web 20 as it is unwound from web roll 30*a*. The printing pattern 36 is applied to the front face 32 of the web 20, and is oriented in registration with the RPSA band 22 on the back face 34 thereof. As illustrated, the printing pattern is formed from a plurality of rows 37 of longitudinally extending identical indicia patterns 38. Viewed laterally across the web 20, every other row 37 is reversed in readability orientation (i.e., upside down). A longitudinal web separation line 40 is defined between adjacent rows 37 of indicia patterns 38 and is aligned to bisect the band 22 of RPSA 24 on the back face 34 of the web 20. The indicia patterns 38 are oriented so that the top edges thereof are collinear with the web separation line 40.

After printing pattern 36 is placed thereon, the web 20 may then be wound into web roll 42. Alternatively, the web 20 may be further processed prior to being re-wound into roll form. In either event, the web 20 is eventually slit apart along each web separation line 40 to define plural web strips such as web strips 44*a* and 44*b*. Each web strip thus has a longitudinal top edge 46 and a longitudinal bottom edge 48, and prior to slitting, the longitudinal top edges 46 were joined along separation line 40.

Each web strip 44*a* and 44*b* is wound into a web strip roll 50*a* and 50*b*, respectively. As illustrated in FIG. 2, the print orientation for the indicia patterns 38 on the web strip rolls 50*a* and 50*b* is reversed. To provide identical web strip rolls (with identically wound printing orientation), one of the rolls must be re-wound, which adds extra handling and labor expenses to the process. Ultimately, each web strip 44*a* and 44*b* is severed laterally between adjacent longitudinally disposed indicia patterns 38 (as at lateral cut line 52) to define a discrete single note sheet for placement onto an advertising signature or similar workpiece.

Figure 3:
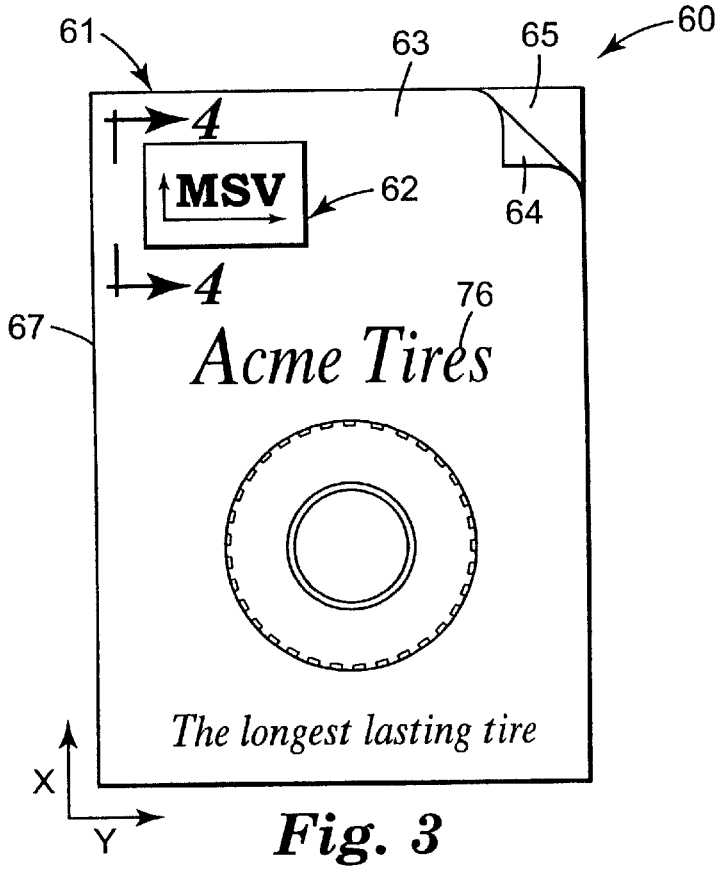
Fig. 3 PRIOR ART
FIG. 3 is a front view of a multipage advertising piece 60 having a repositionable note sheet 62 adhered to the cover 63 thereof.

FIG. 3 illustrates a promotional assembly 60 that includes an advertising piece 61 and a repositionable cut note sheet 62. The advertising piece 61 shown has a plurality of pages, including a first top or cover page 63, a second or opposite inside page 64, a third or juxtapositioned inside page 65, and a fourth or rear page 66. The pages 63, 64, 65 and 66 can be printed on a single sheet which is folded at 67. The repositionable note sheet 62 is secured directly to the advertising piece 61 by a band 22*a* of RPSA 24 (FIG. 4) coated at least partially on the back face 34 of the note sheet 62. The RPSA band 22*a* is formed from a portion of the band 22 of RPSA 24 which had been originally coated on the web 20 (see FIG. 1).

Figure 4:
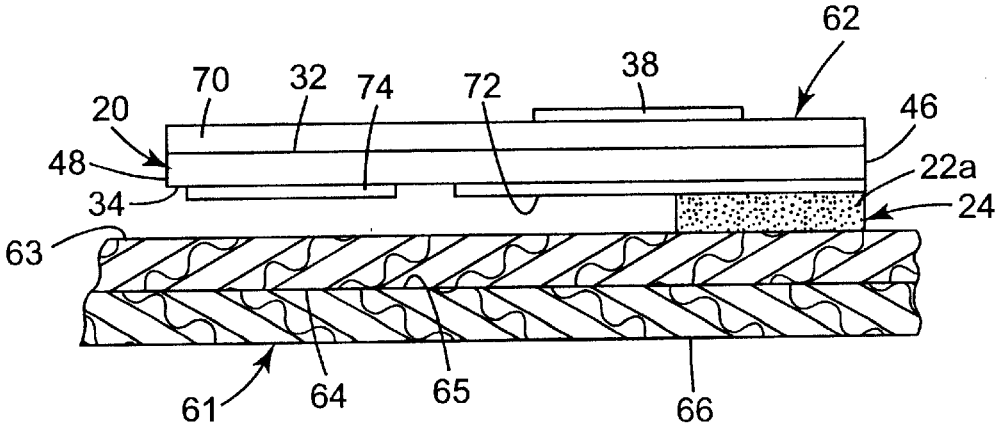
Fig. 4 PRIOR ART
FIG. 4 is a schematic sectional view as taken along lines 4—4 in FIG. 3.

FIG. 4 illustrates the cut note sheet 62 as applied the advertising piece 61. The cut note sheet 62 is formed from a segment of the web 20, and as such, also has the same front face 32 and back face 34 as the web 20. A layer of adhesive release material 70 is shown coated on at least a portion of the front face 32, with the printed indicia pattern 38 applied thereon. On the back face 34 of the web segment 20, a pattern of primer material 72 is illustrated, with the RPSA band 22*a* applied thereover. A second printed indicia pattern 74 (such as printed eyemarks for note sheet registration purposes) is applied to the back face 34 of the web segment forming the note sheet 62, as seen in FIG. 4. The RPSA band 22*a* is adjacent the longitudinal top edge 46, since the web 20 was split through the RPSA band 22 in order to define the web strips 44*a* and 44*b*, both of which ultimately provide the cut note sheets 62. The note sheet 62 may be applied using the methodology and apparatus illustrated in Miles et al. U.S. patent application Ser. No. 08/729,780, in registered alignment with an indicia pattern 76 printed on the cover page 63 of the advertising piece 61.

Inventive Web Strip Formation, Linerless

The deficiencies of the adhesive preprinted note and promotional assembly production processes described in connection with FIGS. 1–4 are addressed and overcome by the present invention. By making revisions to the application of adhesive patterns and correspondingly registered printing to the web, it is no longer necessary to re-wind every other web strip roll. Further, the problem of exposed adhesive along one edge of a web strip roll is overcome by the present invention. The inventive articles and process present a variety of useful characteristics for a roll of preprinted note sheets (with and without a supporting liner sheet) and for the ultimate preprinted note sheets themselves and for promotional materials bearing such note sheets. The result is a faster and more efficient production process, as well as a more useful, attractive and better adhering cut note sheet and finished promotional assembly.

Figure 5:
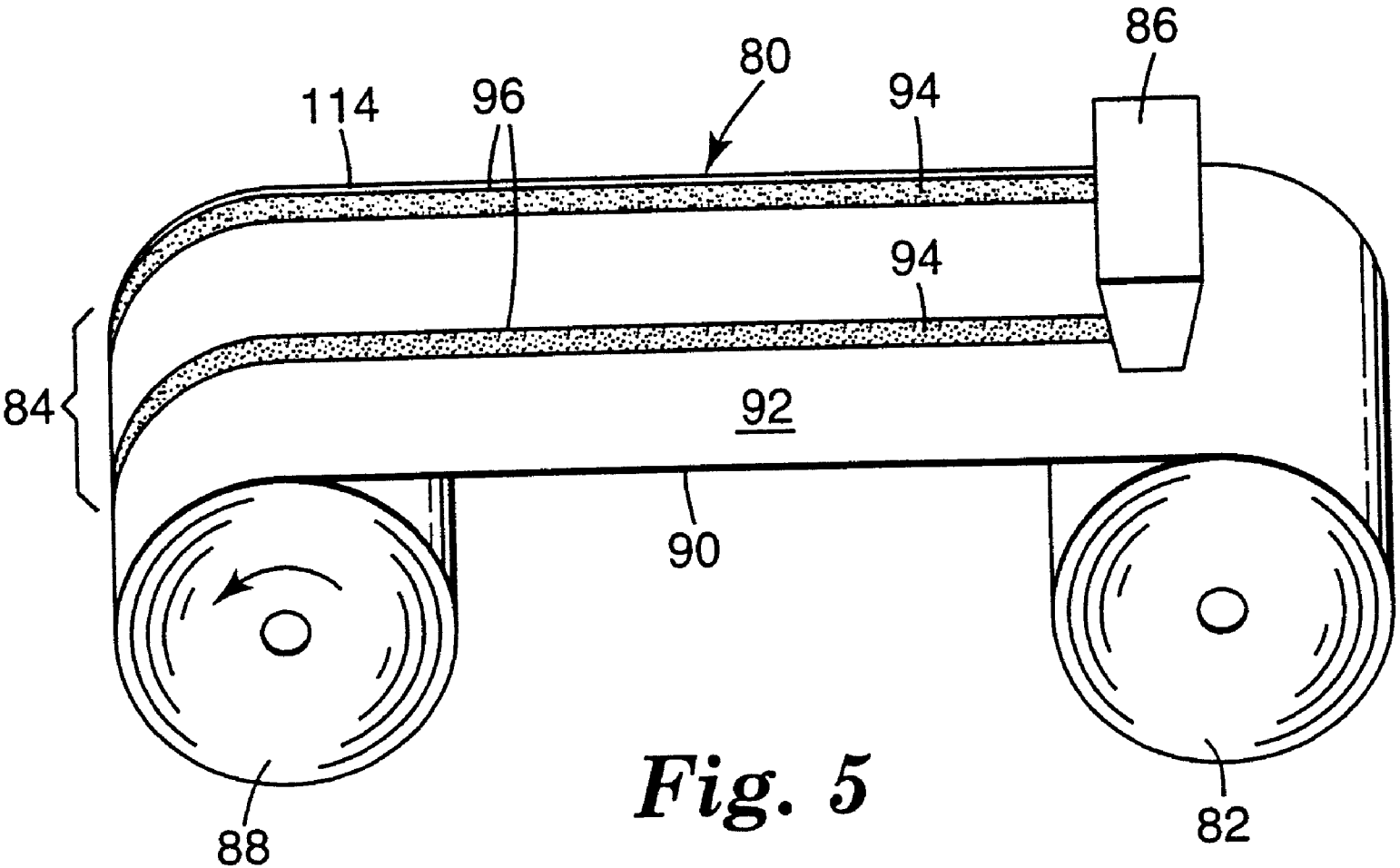
FIG. 5 is a schematic representation of a portion of the inventive process for producing adhesive printed note sheets.

FIG. 5 illustrates the application of an inventive adhesive pattern to a continuous web 80. Suitable materials for the web include, but are not limited to, paper, plastic films, cellulose acetate, ethyl cellulose, polypropylene, woven or nonwoven fabric formed of synthetic or natural materials, metal, metallized polymeric film, ceramic sheet material and the like. Depending upon its material, the web may be transparent, translucent, opaque or a combination thereof. In one preferred embodiment, the web is formed from a paper facestock such as bond paper ranging in weight from 15 to 150 lbs. and ranging in thickness from 2 to 10 mils, and most preferably, from 20 lb. bond paper having a thickness of 4 mils. In another preferred embodiment, the web is formed from a polymeric facestock such as biaxially oriented polyethylene terephthalate (PET) ranging in thickness from 0.5 to 4 mils, and most preferably, 2 mils biaxially oriented PET. Thicker and thinner materials are not precluded.

As seen in FIG. 5, the web 80 is preferably provided as a roll of sheet material 82 which is unwound, has an adhesive pattern 84 applied thereto from an adhesive coating apparatus 86, and is then re-wound as adhesive web roll 88. The web 80 has a front major face 90 and an opposite, back major face 92. In one embodiment, an adhesion promoting material (primer) is also applied to the web 80. In that case, a pattern of primer would be applied to the back face 92 of the web 80 in alignment to underlie the later applied adhesive pattern 84. Further, an adhesive release material (release layer) may also be applied to the front face 90 of the web 80, so that the web 80 may be efficiently wound and unwound for subsequent processing (e.g., web roll 88). Preferably, the release layer is applied over the entire front face 90 of the web 80, prior to printing thereon, since a sheet only partially treated with a release coating may have different printing characteristics than an untreated sheet. Suitable primers and release materials are disclosed in Mertens et al. U.S. Pat. No. 5,618,062, which is incorporated by reference herein.

The adhesive pattern 84 extends longitudinally along the web 80. In a preferred embodiment, the adhesive pattern 84 is defined by a plurality of solid bands 94 of repositionable. pressure-sensitive adhesive (RPSA) 96. While the adhesive pattern 84 herein is illustrated as solid bands of adhesive, alternative patterns are contemplated, depending upon the application. Such alternative patterns may include checkerboard coated patterns of adhesive, nonlinear bands, adhesive graduated in some form laterally across the web (from a more aggressive to less aggressive adhesion) or patterns where the edges of the adhesive are not defined by longitudinal lines (e.g., a wavy edge, zigzag edge, etc.). For simplicity herein, the adhesive patterns are illustrated as bands having longitudinally extending edges. In addition, multiple bands of RPSA may be applied across the web. For simplicity, only two bands are illustrated in the drawing figures.

RPSAs useful in this invention are those that exhibit repositionable, removable characteristics. In this context, the term "repositionable" means that the note sheet can be adhered to and removed from a clean solid surface at least two times without substantially losing tack. Preferably, the sheet can be adhered to and removed from a clean solid surface at least ten times, and more preferably, at least twenty times, without substantially losing tack. RPSAs are well known in the art as evidenced by U.S. Pat. Nos. 5,045,569; 4,988,567; 4,994,322; 4,786,696; 4,166,152; 3,857,731; and 3,691,140, the disclosures of which are incorporated here by reference. A RPSA typically comprises polymeric microspheres having an average diameter of at least about one micrometer. The microspheres are inherently tacky and typically comprise at least about 70 parts by weight of an alkyl acrylate or alkyl methacrylate ester. A majority of the microspheres may contain interior voids, typically, at least about 10 percent of the diameter of the microsphere. RPSAs are tacky to the touch and typically demonstrate a peel adhesion of approximately 10 to 300 gram/centimeters (g/cm), more typically approximately 50 to 250 g/cm, and even more typically about 70 to 100 g/cm. Peel adhesion can be determined according to the test outlined in U.S. Pat. No. 5,045,569. A RPSA can be applied to a sheet using known methods including making a suspension of the microspheres and applying that suspension to the sheet by conventional coating techniques such as knife coating or Meyer bar coating or use of an extrusion dye (see U.S. Pat. No. 5,045,569 at column 7, lines 40–50). Other methods to create repositionable adhesive coatings are well known in the art and may include: printing a fine pattern of adhesive dots; selective detoxification of an adhesive layer; and incorporating non-tacky microspheres in an adhesive matrix. Other useful adhesives include high peel adhesives that may permanently attach a note. Examples of such adhesives include rubber resin and acrylic adhesives.

Figure 6:
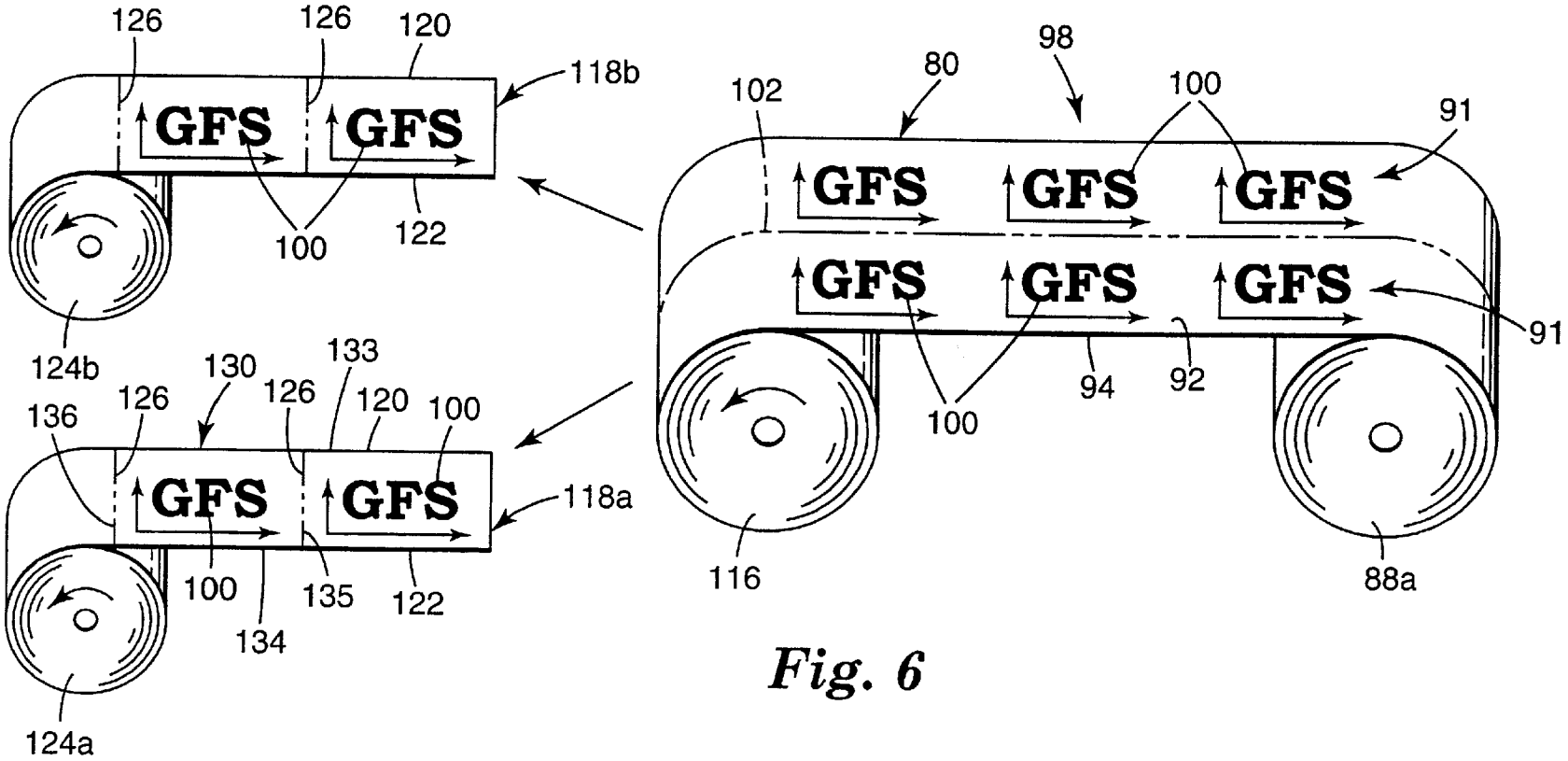
FIG. 6 is a schematic representation of additional steps in the inventive process for producing adhesive printed note sheets.

FIG. 6 illustrates subsequent processing steps for the web 80. The adhesive web roll 88 has been re-wound so that the front face 90 of the web 80 faces radially outward, as designated by web roll 88*a* in FIG. 6. A predetermined printing pattern 98 is applied to the front face 90 of the web 80, oriented in registration with the adhesive bands 94 on the back face 92 thereof. The printing pattern 98 is comprised of a plurality of rows 99 of indicia patterns 100. Again, multiple rows of indicia patterns may be printed on the web, but only two rows are illustrated.

The printing pattern 98 is applied to the web 80 as it is unwound from the web roll 88*a*, and is oriented in longitudinal and lateral registration with the RPSA bands 94 on the back face 92 of the web 80. Viewed laterally across the web 80, each row of indicia patterns 100 has a common orientation for readability and each indicia pattern 100 thus comprises an indicia pattern segment 101 (see FIG. 7) having a top edge 101*a*, a bottom edge 101*b*, a right side edge 101*c* and a left side edge 101*d*. A longitudinal web separation line 102 is defined between each pair of adjacent rows 99 of indicia patterns 100 (since only two rows are illustrated, only one web separation line is shown).

Figure 7:
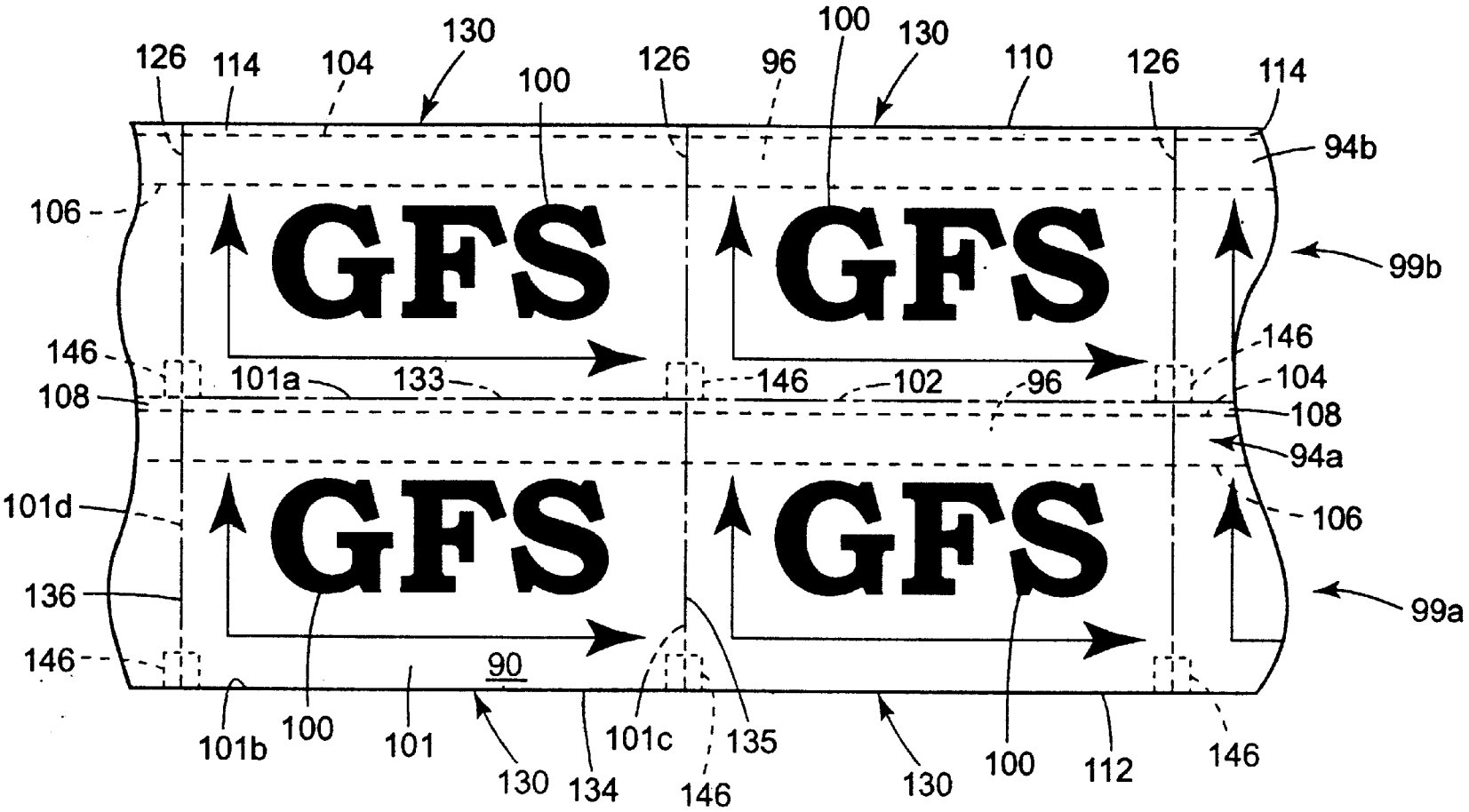
FIG. 7 is a plan view of a portion of the front face of an inventive preprinted web for use in making adhesive printed note sheets.

As illustrated in FIG. 7, in a preferred embodiment, the web separation line 102 does not extend through an RPSA band 94, but is spaced slightly laterally therefrom. More specifically, each RPSA band 94 has a longitudinal adhesive top edge 104 and a longitudinal adhesive bottom edge 106. In FIG. 7, the web 80 is viewed from its front face 90, and the RPSA bands 94 on the back face 92 thereof are shown as dashed or shaded areas of RPSA 96. A longitudinal edge portion area 108, which is free of adhesive, extends between the longitudinal web separation line 102 and longitudinal adhesive top edge 104 of an adjacent RPSA band 94*a*. The web 80 has a top longitudinal edge 110 and a bottom longitudinal edge 112. One RPSA band 94*b* is positioned approximate the top longitudinal edge 110 of the web 80. A longitudinal area 114 free of adhesive extends between the longitudinal top edge 104 of the RPSA band 94*b* and the top longitudinal edge 110 of the web 80. The indicia pattern segments 101 are oriented so that the top edges thereof are collinear with the web separation line 102 (for indicia pattern row 99*a*) or the top longitudinal edge 110 of the web 80 (for indicia pattern row 99*b*). The longitudinal edge portions are preferably about 2 mm wide laterally. Even when closely controlled, some run-over of an adhesive coating from a desired location may occur, so the spacing between the ultimate top edge of the note sheet and the top edge of the RPSA must be wide enough to accommodate coating precision tolerances.

After the printing pattern 98 is placed thereon, the web 80 may then be wound into web roll 116. Alternatively, the web 80 may be further processed prior to being re-wound into roll form. In either event, the web 80 is eventually slit apart along each web separation line 102 to define plural web strips such as web strips 118*a* and 118*b*. Each web strip had a longitudinal top edge 120 and a longitudinal bottom edge 122. Prior to slitting, the longitudinal top edge 120 and bottom edge 122 of laterally adjacent web strips on the web 80 were joined along a common web separation line 102.

Each web strip 118*a* and 118*b* is wound into a web strip roll 124*a* and 124*b*, respectively. As illustrated in FIG. 6, the print orientation for the indicia patterns 100 on the web strip rolls 118*a* and 118*b* are the same upon separation. Thus, no extra handling is required to rewind every other web strip in order to provide a common printing orientation among all web strip rolls.

Ultimately, each web strip 118*a* and 118*b* is severed laterally between adjacent longitudinally disposed indicia patterns 100 (as at lateral cut line 126) to define a discrete single note sheet 130 for placement onto an advertising signature or similar workpiece. The lateral cut lines 126 are also illustrated in FIG. 7. For each indicia pattern segment 101 and indicia pattern 100 thereof, the top and bottom edges 110 and 112 of the web 80, web separation lines 102 and lateral cut lines 126 serve to define the edges thereof.

Figure 8:
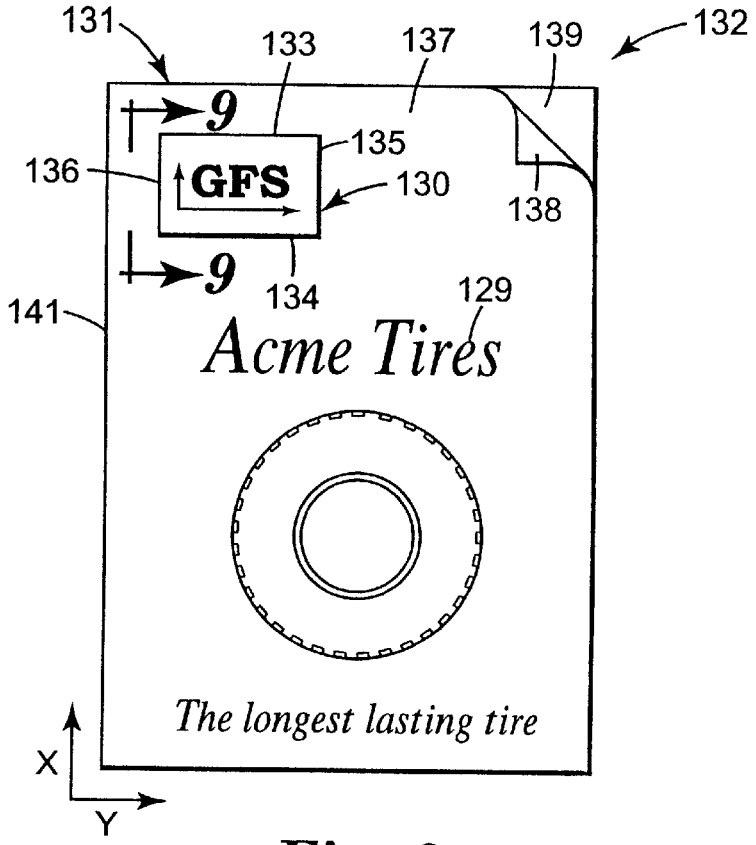
FIG. 8 is a front view of a multipage advertising piece 131 having a repositionable sheet 130 adhered to the cover 137 thereof.

FIG. 8 illustrates one of the repositionable cut note sheets 130 applied to an advertising piece 131, which together form a promotional assembly 132. The note sheet 130 has atop edge 133, bottom edge 134, right side edge 135 and left side edge 136. The note sheet 130 is derived from one of the web strips 118*a* and 118*b* of the web strip rolls 124*a* and 124*b*, and is shown by way of illustration as sample note sheet 130 in FIGS. 6 and 7, which also illustrate the respective edges formed thereon.

Figure 9:
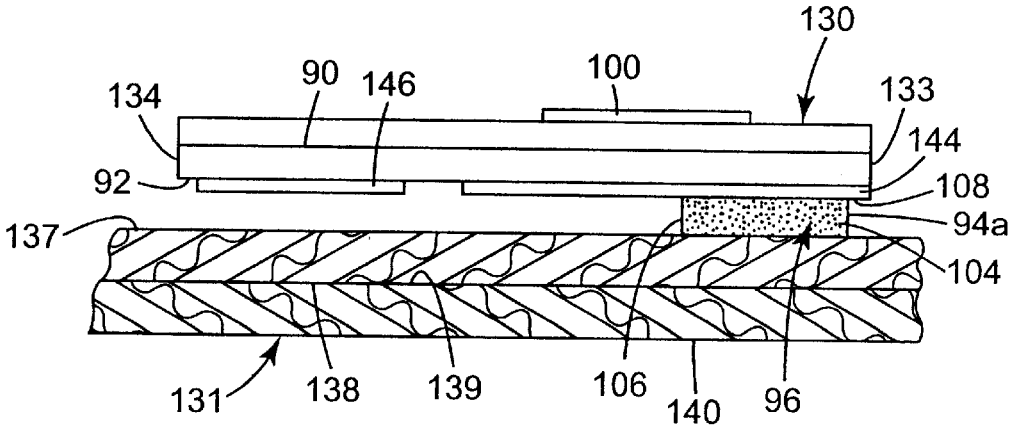
FIG. 9 is a schematic sectional view as taken along lines 9—9 in FIG. 8.

The advertising piece 131 shown in FIGS. 8 and 9 has a plurality of pages, including a first top or cover page 137, a second or opposite inside page 138, a third or juxtapositioned inside page 139, and a fourth or rear page 140. The pages 137, 138, 139 and 140 can be printed on a single sheet which is folded at 141. Additional pages can be formed by increasing the number of folded sheets. In other forms, the advertising piece 131 may comprise a single sheet or multiple sheets bound in some other manner (e.g., stapled or adhered together) or may even comprise a book, letter, product package, etc. For purposes of this application, it is only essential that the article receiving the repositionable note sheet have a face (such as cover page 137) suitable for the adherence of a repositionable note sheet thereon. Advertising piece 131 is a typical example of an advertising "signature."

The repositionable note sheet 130 is secured directly to the advertising piece by an RPSA band, such as the band 94*a* of RPSA 96, aligned on the back face 92 of the note sheet 130, adjacent its top edge 133. As illustrated in FIG. 7, the RPSA band of each note sheet 130 extends completely from its right edge 135 to its left edge 136, but does not extend to its top or bottom edges 133 and 134. The area free of adhesive between the top edge 104 of the band and the top edge 133 of the note sheet is illustrated as at 108 in FIG. 9.

FIG. 8 illustrates the note sheet 130 as applied to the advertising piece 131, in registered alignment with an indicia pattern 129 printed on the cover page 137 of the advertising piece 131. The cut note sheet 130 is formed from a segment of the web 80 and as such, also has the same front face 90 and back face 92 as the web 80. A layer of adhesive release material 142 is shown coated on at least a portion of the front face 90, with the printed indicia pattern 100 applied thereon. Alternatively, the indicia pattern 100 may be applied to the front face 90 directly, with the release layer 142 applied thereover. A pattern of primer material 144 may be applied to the back face 92 of the web segment 80, with the RPSA 96 applied thereover.

A second printed indicia pattern (such as printed eyemarks 146 for note sheet registration purposes) may also be applied to the back face 92 of the web segment 80 forming the note sheet 130, as seen in FIGS. 7 and 9 (in FIG. 7, although viewed from the front face 90 of the web 80, the eyemarks 146 are illustrated as dashed or shaded marks thereon, for illustrative purposes.) The second printed indicia pattern is a series of equally spaced (and preferably identically shaped) eyemarks 146 printed on the back face 92 of the web 80, as illustrated in FIG. 7. The eyemarks 146 can be printed on the web 80 at any time prior to its separation into web strips 118*a* and 118*b*. The eyemarks 146 are later used to define the cut length and control parameters for the note sheet application apparatus which severs the cut note sheets 130 from the web strip rolls 124 and applies them to their respective workpieces. Preferably, the eyemarks 146 are positioned along what would be the lateral cut line (separation line 126) between adjacent cut sheets 130 of each row of indicia patterns on the web strip, so that after cutting, half of each eyemark 146 is borne by subsequently cut adjacent note sheets 130.

A note sheet application apparatus suitable for this purpose is disclosed in Miles et al. U.S. patent application Ser.

No. 08/729,780, and has an optical sensor which is aligned to view the back face 92 of the web strip 118 and detect the eyemarks 146 thereon during advance of the web strips 118 for cutting and positioning thereof on a workpiece such as advertising piece 131. The optical sensor detects changes in opacity. Thus, dependent upon the color of the sheet material comprising the web, the eyemark may be darker or lighter than the web, so long as the change in contrast between the eyemark and the web is sufficient to generate a detection signal by the optical sensor. Typically, the eyemark 146 will be a mark made with black ink, printed on a lighter colored substrate. When the substrate is transparent or sufficiently translucent that changes in opacity may be detected therethrough, the indicia pattern 100 printed on the front face 90 of the web 80 may also serve as its eyemark for cutting and positioning registration relative to a workpiece. While the eyemarks 146 illustrated in FIG. 7 are in the form of relatively small black marks disposed across the back face 92 of the web 80, they can take alternative forms, such as laterally disposed lines printed across the web 80. Preferably there is an eyemark (or at least a portion thereof) aligned on the back face 92 of the web 80 in registration with the indicia pattern 100 on the front face 90 for each cut note sheet 130.

The promotional assembly 132 employing the inventive repositionable note sheet 130, and its related inventive production process, present significant advantages over the prior art. No adhesive is exposed along the top edge of the cut note sheet, thus presenting less adhesive for inadvertent pickup of dirt and debris during processing or in finished product form. Likewise, the lateral separation of adhesive from the longitudinal web separation lines means that the adhesive is not being engaged by the separation knives, thereby making the necessity for their cleaning less frequent. This reduces both process downtime and labor costs. Further, the inventive orientation of the adhesive pattern and the commonly readable orientation of the indicia pattern means that laterally alternating web strip rolls need not be rewound to place all web strip rolls in common image orientation for application to an advertising piece. This again reduces equipment processing time and labor costs. In high volume applications such as is frequent in connection with direct-mail and advertising promotional activities, these revisions and enhancements to the process, intermediate articles and finished product are quite significant and very cost effective.

Figure 10:
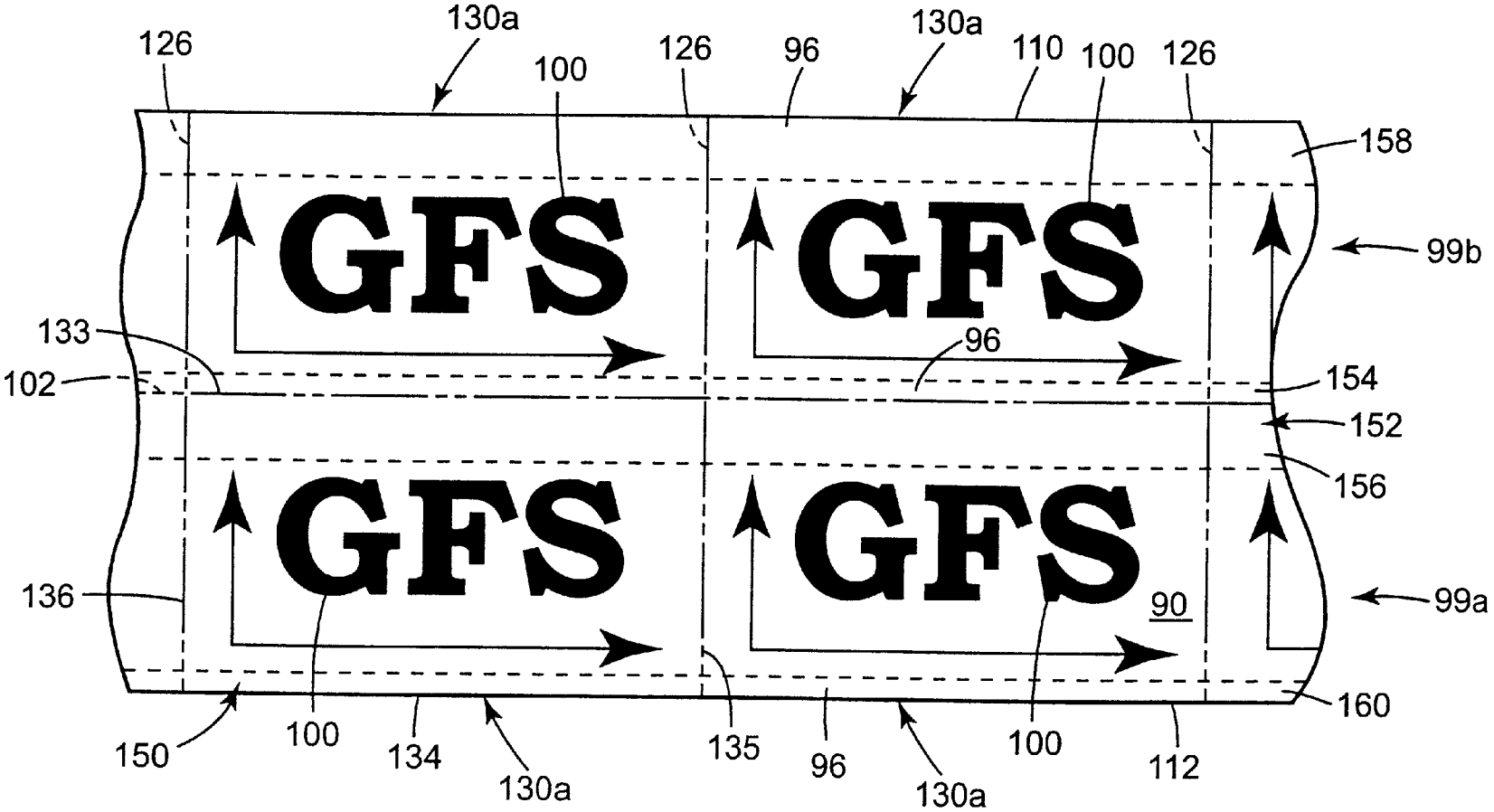
FIG. 10 is a plan view of a portion of the front face of the inventive preprinted web used in making adhesive printed note sheets, with a second alternative adhesive pattern thereon.

Alternative embodiments of these inventive concepts present additional benefits for other desired cut note sheet applications. For example, FIG. 10 illustrates a web 150 which is identical in all respects to web 80 except for the adhesive pattern disposed on the back face 92 thereof. In this embodiment, the adhesive pattern is applied so that the longitudinal separation line 102 extends through a band 152 of RPSA 96. The splitting of the RPSA band 152 by the separation line 102 is preferably asymmetrical, so that a thinner or narrower band thereof is aligned along the bottom of one row of indicia patterns, while a thicker band thereof is aligned along the top of an adjacent row. In FIG. 10, the thinner band adjacent the bottom edge of one row is designated as RPSA band 154, while the thicker band along the top edge of an adjacent row is designated as RPSA band 156. Along a top edge 110 of the web 150, an RPSA band 158 (similar in lateral dimension to thicker RPSA band 156) is disposed, and likewise, along a bottom edge 112 of the web 150, an RPSA band 160 (similar in lateral dimension to thinner RPSA band 154) is disposed. While only two rows of indicia patterns 99*a* and 99*b* are illustrated in FIG. 10, any number of such rows may be printed laterally across the web 150, and would be accompanied in registered alignment by a corresponding number of RPSA bands 152 and a corresponding number of web separation lines 102.

Upon separation of discrete cut note sheets from the web 150 (as previously described), each cut note sheet 130*a* thus has a band of RPSA 96 adjacent its top edge 133 and a band of RPSA 96 adjacent its bottom edge 134. The adhesive 96 for each note sheet 130*a* thus extends along its top and bottom edges 133 and 134, and along upper and lower portions of its side edges 135 and 136. A note sheet 130*a* of this construction thus presents a note sheet with increased adhesive capability, particularly along its bottom and side edges.

Figure 11:
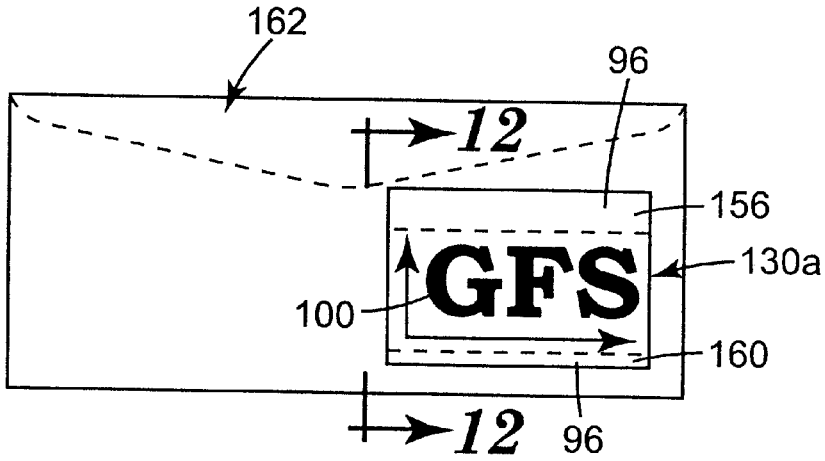
FIG. 11 is a front view of a direct-mailing envelope 162 having a repositionable sheet 130*a* thereon.
Figure 12:
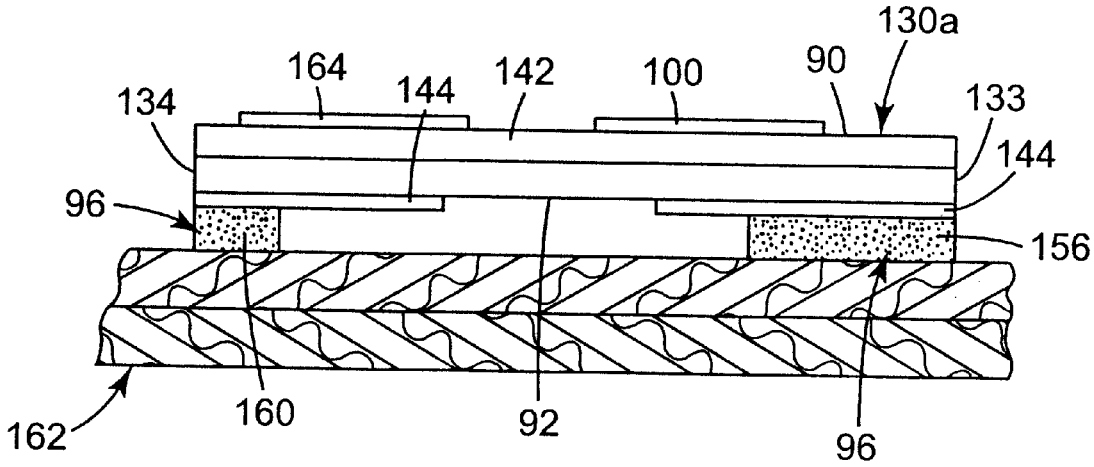
FIG. 12 is a schematic sectional view as taken along lines 12—12 in FIG. 11.

FIGS. 11 and 12 illustrate such a note sheet 130*a* as applied to a direct-mailing piece, such as a mailing envelope 162. In addition to bearing the indicia pattern 100 on its front face 90 and adhesive 96 on its back face 92, the note sheet 130*a* may also bear a release layer 142 on its front face, and a primer pattern 144 on its back face. In addition, a further indicia pattern may be printed on the front face 90, such as indicia pattern 164. Indicia pattern 164 may be in a different color ink than indicia pattern 100, or one indicia pattern may be the same for all of the note sheets (e.g., a postal return address), while the other indicia pattern may include different information for each note sheet (e.g., a different mailing address for each note sheet, to use the note sheets as mailing labels on direct-mail envelopes). As illustrated in FIGS. 10, 11 and 12, a significant portion of the back face 92 of the note sheet 130*a* is free of adhesive, between the thinner RPSA band at its bottom edge 134 and the thicker RPSA band at its top edge 133. While not shown in these figures, this embodiment of the invention also preferably includes a pattern of printed eyemarks on its back face 92 for use in registration during cutting and applying the note sheets 130*a* to a workpiece.

Figure 13:
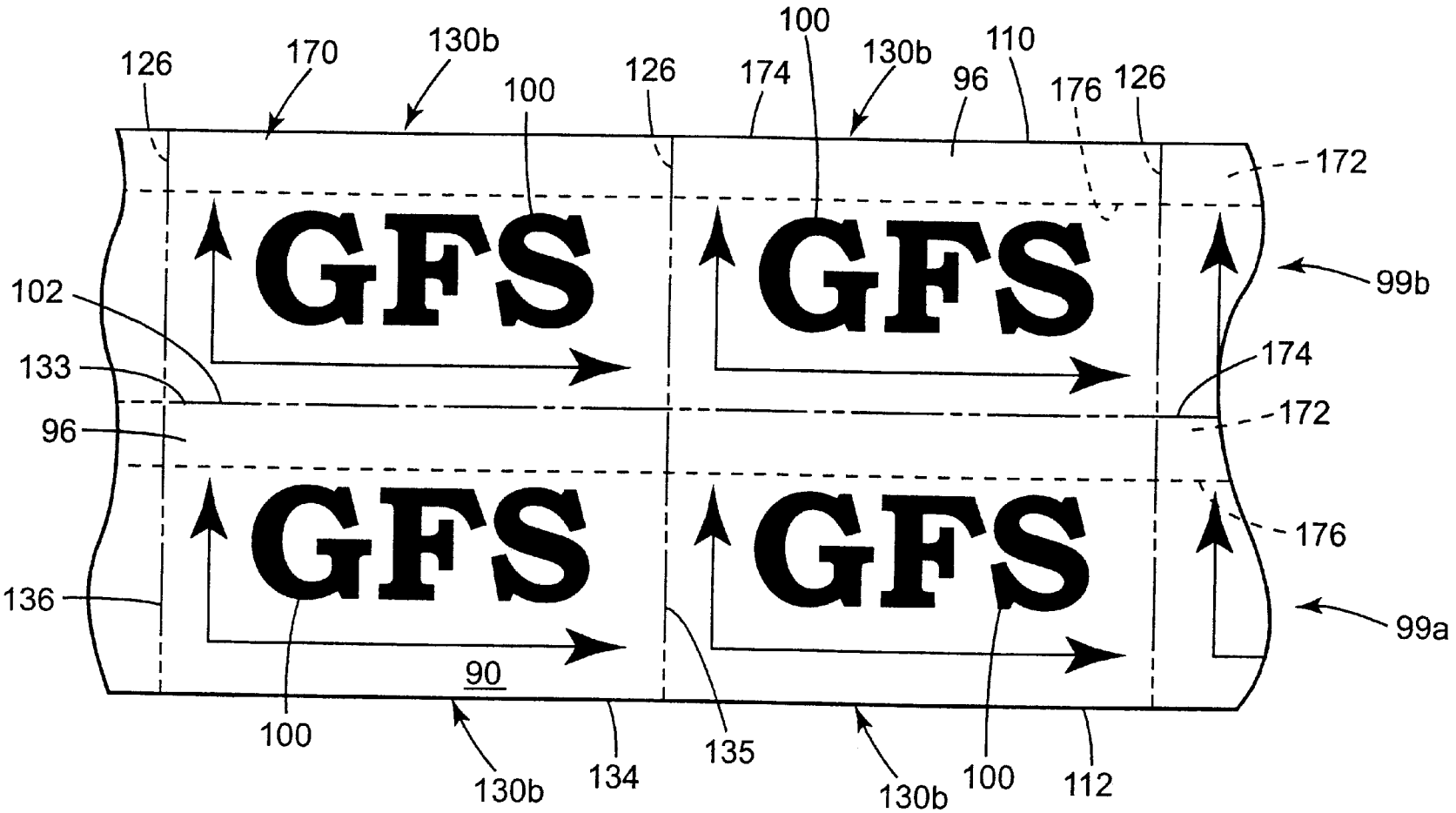
FIG. 13 is a plan view of a portion of the front face of the inventive preprinted web used in making adhesive printed note sheets, with a third alternative adhesive pattern thereon.

FIG. 13 illustrates another embodiment of the present invention. In this embodiment, a web 170 is again similar in all respects to the web 80, except for the adhesive pattern configuration disposed on the back face 92 thereof. In this embodiment, the adhesive pattern is a plurality of identical bands 172 of RPSA 96. Each band has a top longitudinally extending edge 174 and a bottom longitudinally extending edge 176. As illustrated, each band is oriented relative to the adhesive patterns 100 on the first face 90 of the web 170 to be aligned adjacent the top edge of each note sheet 130*b* formed therefrom. Each web separation line 102 extending longitudinally along the web 170 is colinear with (1) the top edge 174 of any adjacent RPSA band 172, (2) the top edge 133 of one note sheet 130*b* and (3) the bottom edge 134 of a laterally adjacent note sheet 130*b* on the web 170. Thus, the longitudinal separation line 102 does not extend through an adhesive band 172, but extends along the top edge 174 thereof, separating the bottom (free-of-adhesive) portion of one note sheet 130*b* from the top (bearing adhesive) portion of a laterally adjacent note sheet 130*b*. For the row 99*a* of indicia patterns 100 that are next to the bottom edge 112 of the web 170, the free-of-adhesive bottom portion of the note sheets 130*b* formed therefrom extends to the bottom edge 112 of the web 170. Likewise, for that row 99*b* of image patterns 100 adjacent the top edge 110 of the web 170, the top adhesive-bearing portion (RPSA band 172) of those respective note sheets 130*b* extends to the top edge 110. The web 170 bears a pattern of registration eyemarks on its second side 92 thereof, although the eyemarks are not shown in FIG. 13, for clarity. While only two rows of indicia patterns 99*a* and 99*b* are illustrated in FIG. 13, any number of such rows may be printed laterally across the web 170, and would be accompanied in registered alignment by a corresponding number of RPSA bands 172 and a corresponding number of web separation lines 102. A lateral section of one note sheet 130*b* taken from the web 170 is generally illustrated by the schematic view of FIG. 4.

Figure 14:
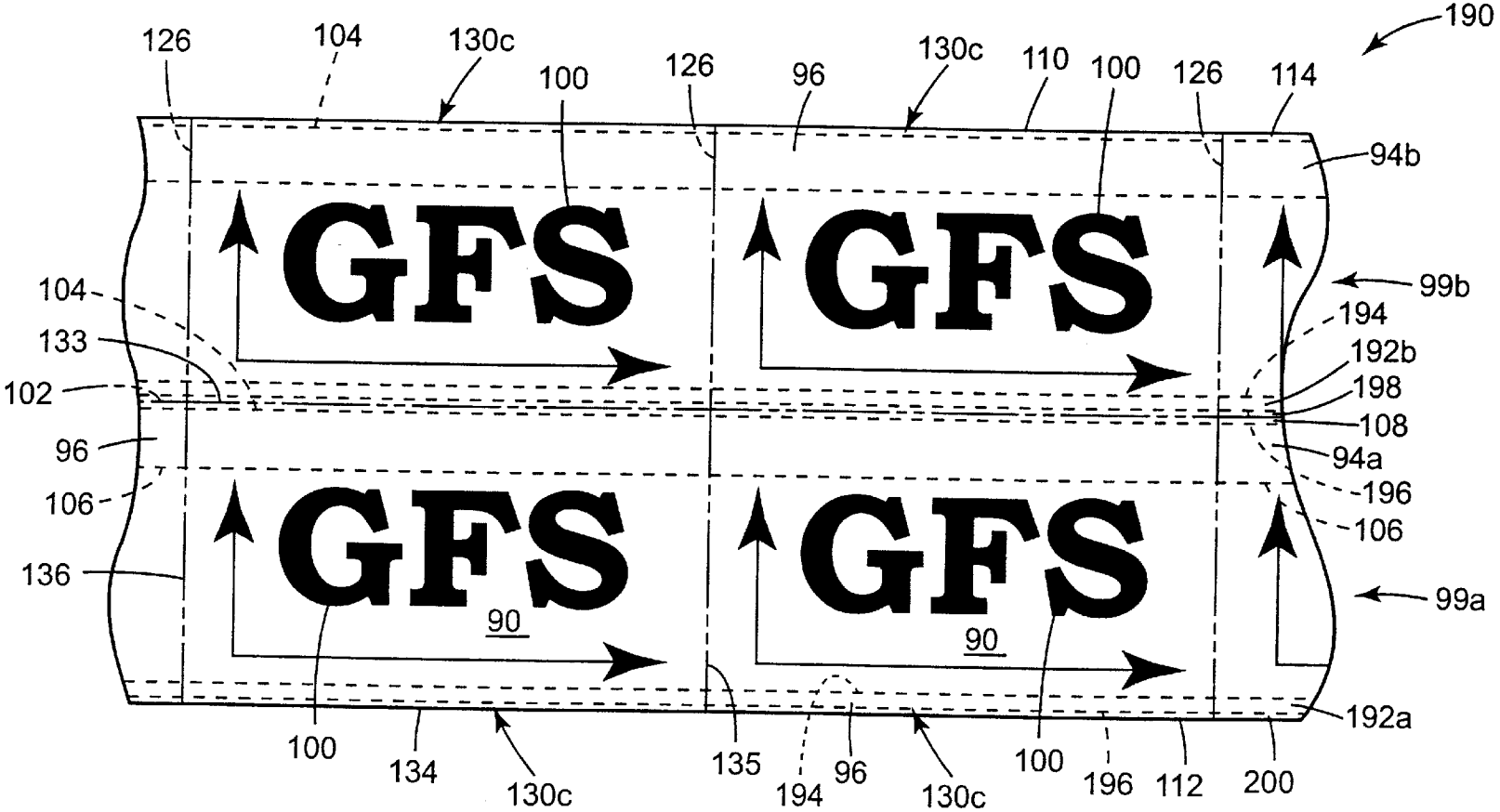
FIG. 14 is a plan view of a portion of the front face of the inventive preprinted web used in making adhesive printed note sheets, with a fourth alternative adhesive pattern thereon.

FIG. 14 illustrates a further embodiment of the present invention. In FIG. 14, a web 190 is formed which is identical in all respects to the web 80, except for the inclusion of an additional RPSA adhesive pattern disposed on the back face 92 thereof. In this embodiment, solid bands 94 of RPSA 96 are aligned on the back face 92 of the web 190 as previously described, such as bands 94*a* and 94*b* in FIG. 14. The top edge 104 of each band 94*a* adjacent the longitudinal web separation line 102 is spaced or set back slightly from the separation line 102 to define a longitudinal area free of adhesive 108 therebetween. Likewise, the top edge of the adhesive band 94*b* adjacent the top edge 110 of the web 190 is spaced or set back slightly from the top edge 110 to define a longitudinal area 114 free of adhesive therebetween.

The additional RPSA pattern is formed by a plurality of RPSA bands 192 aligned on the back face 92 of the web 190, adjacent the bottom portion of each row 99 of indicia patterns 100. RPSA band 192*a* is illustrated for row 99*a*, and RPSA band 192*b* is illustrated for row 99*b*. Preferably, each RPSA band 192 is laterally narrower or thinner than the RPSA bands 94, although any relative band width relationship is possible (such as equally wide bands). Each RPSA band 192 has a longitudinally extending top edge 194 and a longitudinally extending bottom edge 196. The bottom edge 196 of any RPSA band 192 adjacent the longitudinal web separation line 102 (such as RPSA band 192*b*) is spaced or set off slightly therefrom to define a longitudinal area 198 free of adhesive adjacent the bottom edge of each row (which in turn becomes the bottom edge 134 of each note sheet 130*c* derived therefrom). The bottom edge 196 of the RPSA band 192*a* adjacent the bottom edge 112 of the web 190 is also slightly set off or spaced from the bottom edge 112, thereby defining a longitudinal area 200 free of adhesive therebetween (preferably, the spacing or setoff is about 2 mm). Accordingly, with the web 190 of this embodiment, a note sheet 130*c* is formed which is free of adhesive along its top edge 133 and bottom edge 134, yet has portions of adhesive extending adjacent to those edges. This again facilitates the longitudinal slitting of the web 190, since the knife which severs the web 190 along web separation line 102 does not encounter any adhesive, but passes instead through the adjoining free-of-adhesive areas 108 and 198. Again, the web 190 preferably includes a pattern of registration eyemarks printed on the back face thereof, but the eyemarks have been omitted from FIG. 14 for clarity. Likewise, while only two rows of indicia patterns 99*a* and 99*b* are illustrated in FIG. 14, any number of such rows may be printed laterally across the web 190, and would be accompanied in registered alignment by a corresponding number of RPSA bands 94 and 192, and a corresponding number of web separation lines 102.

Inventive Web Strip Formation, With Liner Sheet

The above-described embodiments of the present invention all set forth an inventive web which is linerless. In other words, the web is transported throughout all steps of the production and application process as a single sheet, with no liner supporting that sheet when carried or processed as a web strip or in roll form. However, in some applications a liner sheet used in connection with the web bearing the note sheet indicia patterns is advantageous. FIGS. 15–21 illustrate embodiments of the present invention where a liner sheet is included in the inventive web strip assembly. In these embodiments, a web strip is formed in the manner disclosed above (having the advantageous adhesive/indicia pattern orientations) and then adhered or laminated (via the RPSA on its back face) to a liner sheet or carrier web to define a web strip assembly. The web strip assembly is then further processed and ultimately, discrete cut note sheets bearing the indicia patterns are separated from the liner sheet and applied to a workpiece in a desired orientation thereon.

Figure 15:
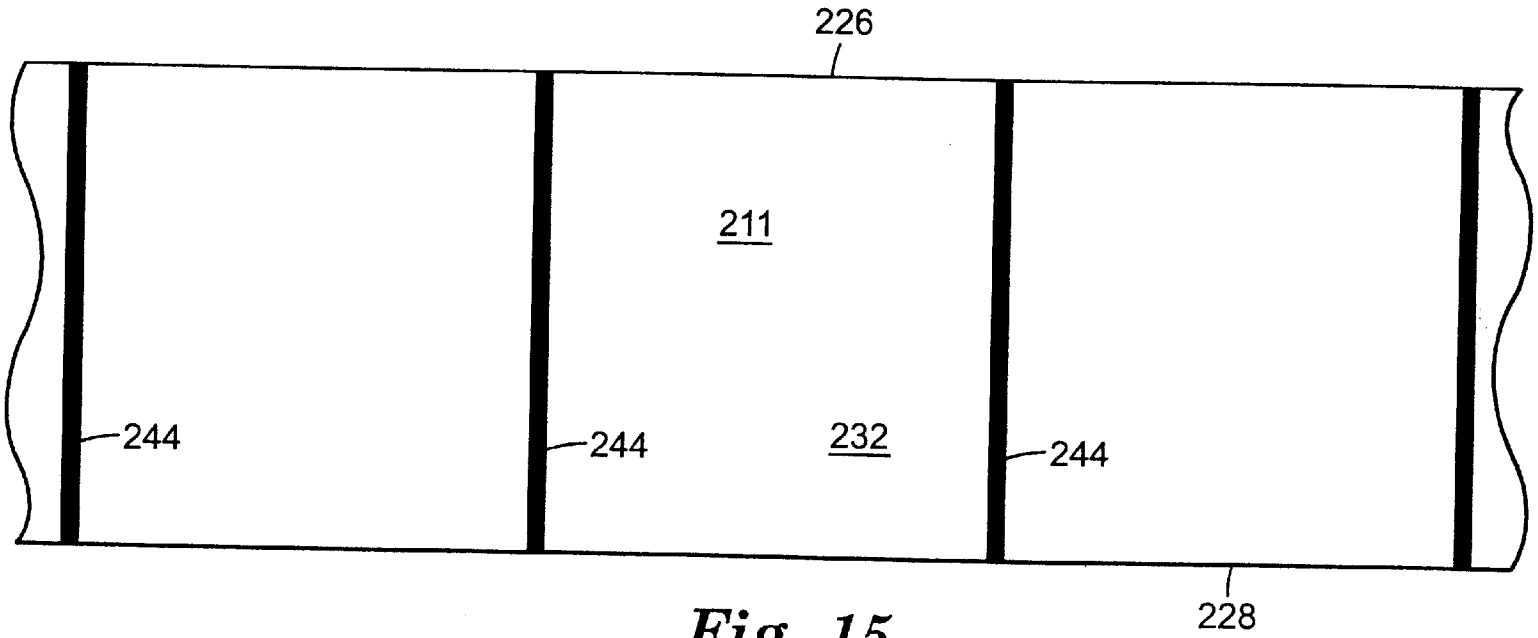
FIG. 15 is a plan view of a portion of the first face of a liner sheet for use in a web strip assembly of the present invention.
Figure 16:
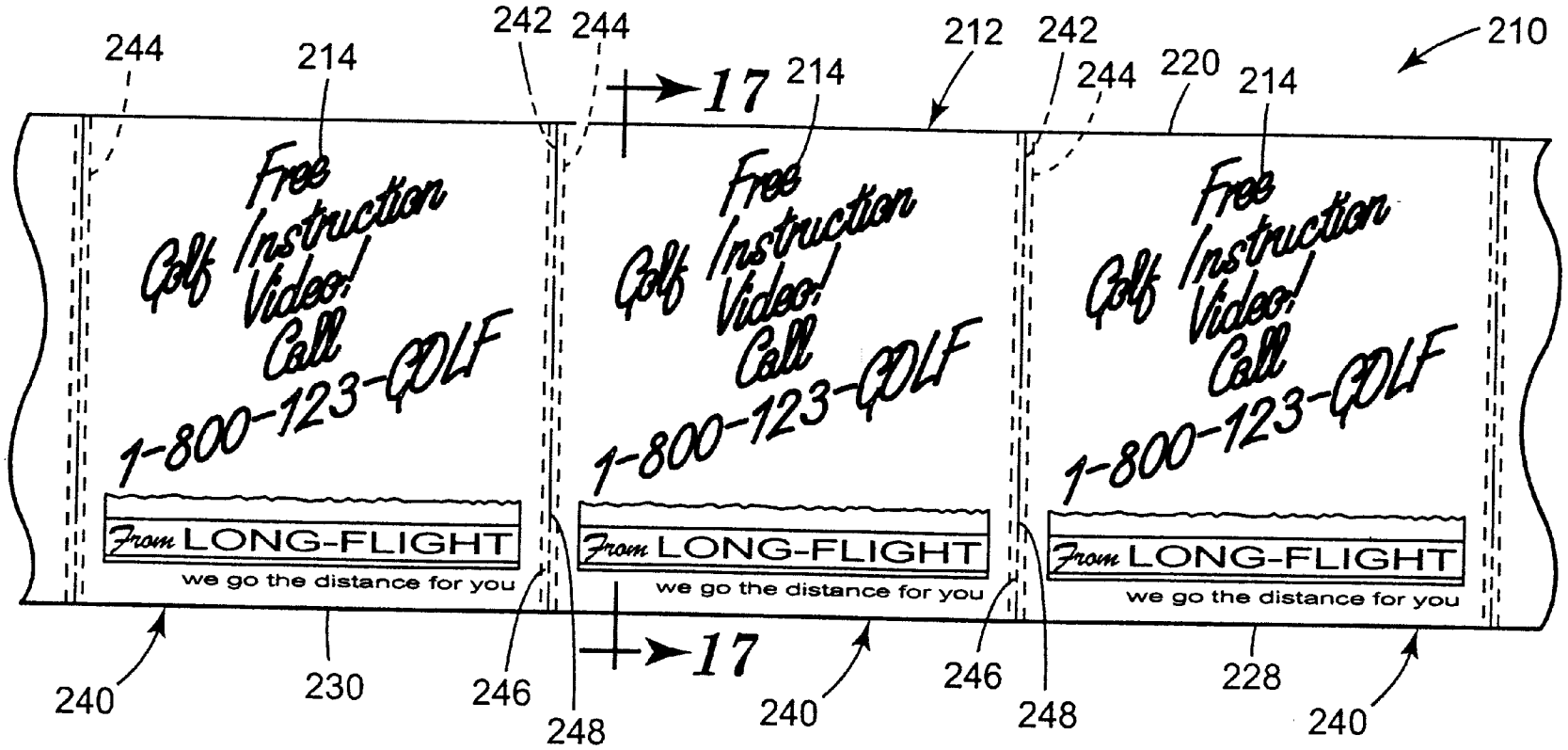
FIG. 16 is a plan view of a portion of the front face of a web strip assembly of the present invention, using the liner sheet of FIG. 15.
Figure 17:
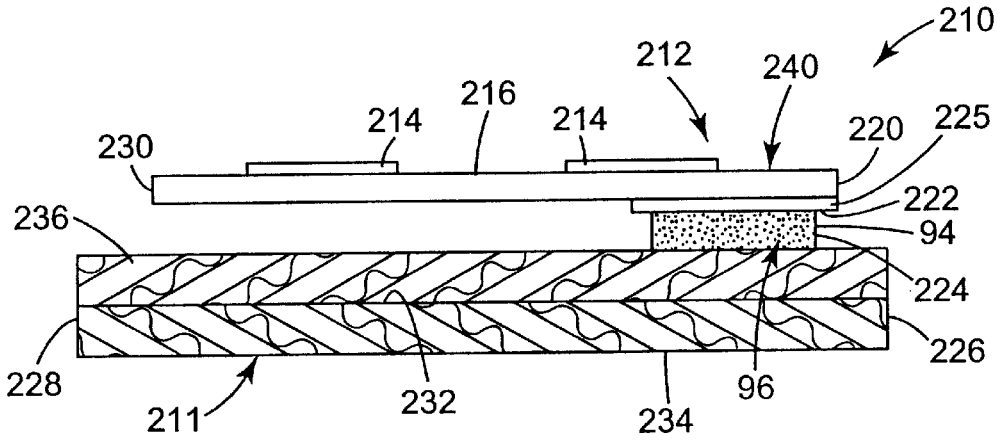
FIG. 17 is a schematic sectional view as taken along lines 17—17 in FIG. 16.

FIGS. 15, 16 and 17 show one illustrative embodiment of an inventive web strip assembly 210, having a liner sheet 211 laminated to a web strip 212. As before, each web strip 212 is formed as one longitudinal section taken from a web which has had rows of commonly readable indicia patterns printed on its front face and an adhesive pattern coated on its back face in registered orientation with the indicia pattern rows. Accordingly, each web strip 212 has one of the rows of indicia patterns 214 printed on a front face 216 thereof, with a corresponding pattern of RPSA 96 disposed on a back face 218 thereof (see FIG. 17). In a preferred embodiment, the adhesive pattern is a band 94 of RPSA 96, aligned adjacent a top longitudinal edge 220 of the web strip 212, with a longitudinally extending area 222 free of adhesive left between a top edge 224 of the RPSA band 94 and the top edge 220 of the web strip 212. As previously illustrated, the RPSA band 94 is relatively narrow in a lateral orientation, compared to the top-to-bottom lateral dimension of the web strip 212. If desired, a primer layer 225 may be disposed between the bottom face 218 of the web strip 212 and the RPSA 96.

The liner sheet 211 has a top longitudinal edge 226 and a bottom longitudinal edge 228. Likewise, the web strip 212 has a top longitudinal edge 220 and a bottom longitudinal edge 230. When the web strip 212 and liner sheet 211 are adhered together to form the web strip assembly 210 illustrated in FIGS. 16 and 17, the top edges 220 and 226 are colinear and the bottom edges 230 and 228 are colinear. The liner sheet 211 has a first face 232 and a second face 234, and preferably has a layer of adhesion release material 236 on its first face 232 (applied either before or after the indicia patterns 214 are printed thereon). Suitable materials for the liner sheet include, but are not limited to, paper, plastic films, cellulose acetate, ethyl cellulose, woven or nonwoven fabric formed of synthetic or natural materials, metal, metallized polymeric film, polypropylene, ceramic sheet material and the like. Depending upon its material, the liner sheet may be transparent, translucent, opaque or a combination thereof. In one preferred embodiment, the liner sheet is formed from silicone coated paper ranging in basis weight from 15 to 70 lbs. and ranging in thickness from 1 to 7 mils, and most preferably, from 50 lb. silicone-coated paper having a thickness of 3 mils (Daubert 4025 paper, available from Daubert VCI, Inc., Westchester, Ill.).

The laminated web strip assembly 210 illustrated in FIGS. 16 and 17 is further processed and the note sheets formed thereon can be applied to a workpiece using conventional label application equipment, such as the Model Q60B labeler of QLS Labeling Systems, Eastlake, Ohio, or the Model 2111ST of Label-Aire Incorporated, Fullerton, Calif. A specific step in such further processing is the formation of discrete cut note sheets 240 from the web strip 212, while retaining those cut note sheets 240 on the liner sheet 211. To achieve that end, lateral web strip separation cuts are made across the web strip 212 to separate the web strip into adjacent longitudinally disposed note sheets 240. Such lateral cuts 242 are made in equal longitudinal spacings along the web strip 212, thus forming a plurality of identical note sheets 240 borne by the liner sheet 211. The lateral severing along line 242 is done in a die cut process using a knife having a cut depth sufficient to sever the substrate defining the web strip 212, but not cutting deep enough to sever the liner sheet 211 thereunder (a "kiss" cut technique). Adjacent note sheets 240 thus abut along their respective side edges 246 and 248. As the note sheets 240 are sequentially removed from liner sheet 211 for adherence to workpieces, the liner sheet is rewound and then discarded as process waste.

The registration of the advancing note sheets 240 relative to workpiece (from left to right as viewed in FIG. 16) application is maintained by the use of a printed pattern of eyemarks 244 on the liner sheet 211. Preferably, the eyemarks 244 are black lines extending laterally across the liner sheet at equally longitudinally spaced locations (see FIG. 15). At least a portion of each eyemark 244 is used for registration of the indicia pattern 214 on a corresponding one of the note sheets 240. In the illustrated embodiment of the liner sheet 211, the liner sheet substrate is light or pale in opacity (e.g., white or yellow) and the eyemarks 244 are printed in a dark opacity ink (e.g., black). The substrate forming the web strip 212 (and note sheets 240) is transparent or sufficiently translucent that the dark eyemarks 244 are optically detectable through the front face 216 of the web strip 212. This is illustrated in FIG. 16, where the optically detectable edges of the dark eyemarks 244 on the liner sheet 211 are illustrated in dashed lines. The eyemarks 244 shown in FIG. 16 are aligned so that each eyemark is bisected by one of the lateral web strip separation cuts 242. In a preferred embodiment, each eyemark 244 is ⅛-inch wide, and has its right (leading) edge spaced ¼-inch to the left of one of the lateral web strip separation cuts 242.

While FIG. 17 illustrates an adhesive pattern for the web strip 212 having only one RPSA band 94 per cut note sheet 240, any adhesive pattern will suffice, including specifically those adhesive patterns of alternative embodiments disclosed herein. Likewise, this particular embodiment may include any of the other features disclosed among the various embodiments, as applicable (e.g., multiple printing patterns, eyemark shapes, the use of primers or release layers, etc.).

Figure 18:
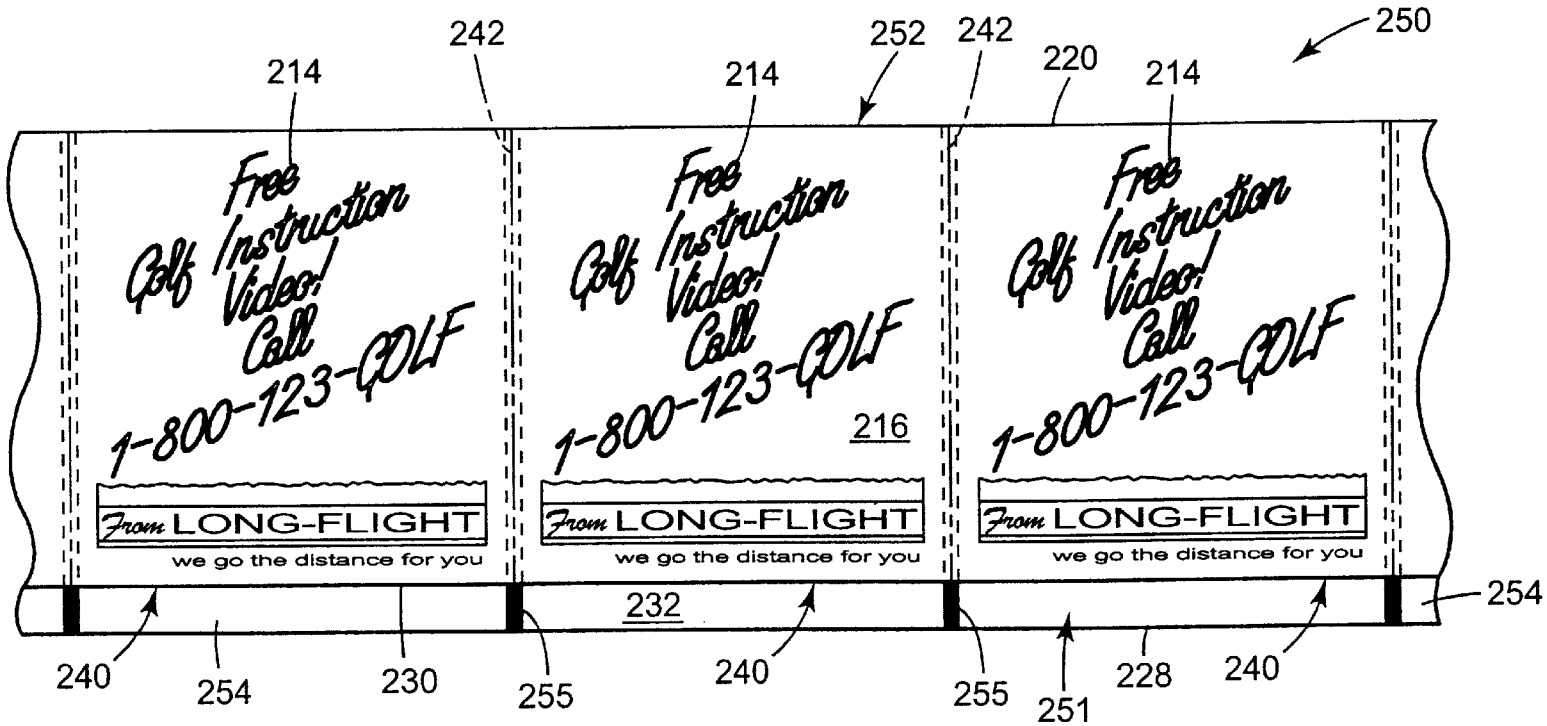
FIG. 18 is a plan view of a portion of the front face of a second alternative embodiment of the web strip assembly of the present invention.

FIG. 18 illustrates another embodiment of a web strip assembly 250 which includes a web strip and liner sheet. In this embodiment, the web strip 252 has a similar construction to the web strip 212 previously discussed. A liner sheet 251 in this embodiment is similar in construction to the liner sheet 211 previously discussed, except for being laterally wider than the liner sheet 211. Because the liner sheet 251 is laterally wider than the web strip 252, a longitudinally extending edge portion 254 thereof extends beyond the bottom edge 230 of the web strip 252. The top edge 220 of the web strip 252 is coterminous with a top edge of the liner sheet 251. However, the bottom edge 230 of the web strip 252 is not coterminous with a bottom edge 228 of the liner sheet 251, but rather is set back or spaced laterally therefrom.

A pattern of longitudinally spaced eyemarks 255 are printed on the first face 232 of the liner sheet 251. At least a portion of each eyemarks 255 is printed on the edge portion 254, so that it is visible from the first face side of the web strip 252. The eyemarks 255 may also be of sufficiently dark opacity (relative to the substrate of the web strip 252) to be visibly detectable through the substrate (transparent or translucent) of the web strip 252 from its first face side, but such an opacity relationship between the substrate of the web strip 252 and the eyemarks 255 is not necessary since the portions of eyemarks 255 are clearly visible along the edge portion 254.

The preferred method for forming a web strip assembly such as that shown in FIG. 18 is to form the web strip 252 and liner sheet 251 with the same lateral width, laminate those sheets together and then die cut the web strip to make the lateral web separation cuts 242 and to remove a longitudinal portion of the web strip 252 from over the longitudinally extending edge portion 254 of the liner sheet 251. Again, the knife employed for this die cutting process penetrates deep enough into the web strip assembly to sever the web strip 252, but not deep enough to engage or sever the liner sheet 251. The result is a plurality of longitudinally disposed and abutting cut note sheets 240 carried on the liner sheet 251 for further processing. As shown, the eyemarks 255 are aligned so that each eyemark is bisected by one of the lateral web strip separation cuts 242. In a preferred embodiment, each eyemark 255 is ⅛-inch wide, and has its right (leading) edge spaced ¼-inch to the left of one of the lateral web strip separation cuts 242. Further, the features of the embodiment of FIG. 18 may be combined with any of the other inventive features disclosed herein, such as applying an alternative adhesive pattern on the note sheets 240.

Figure 19:
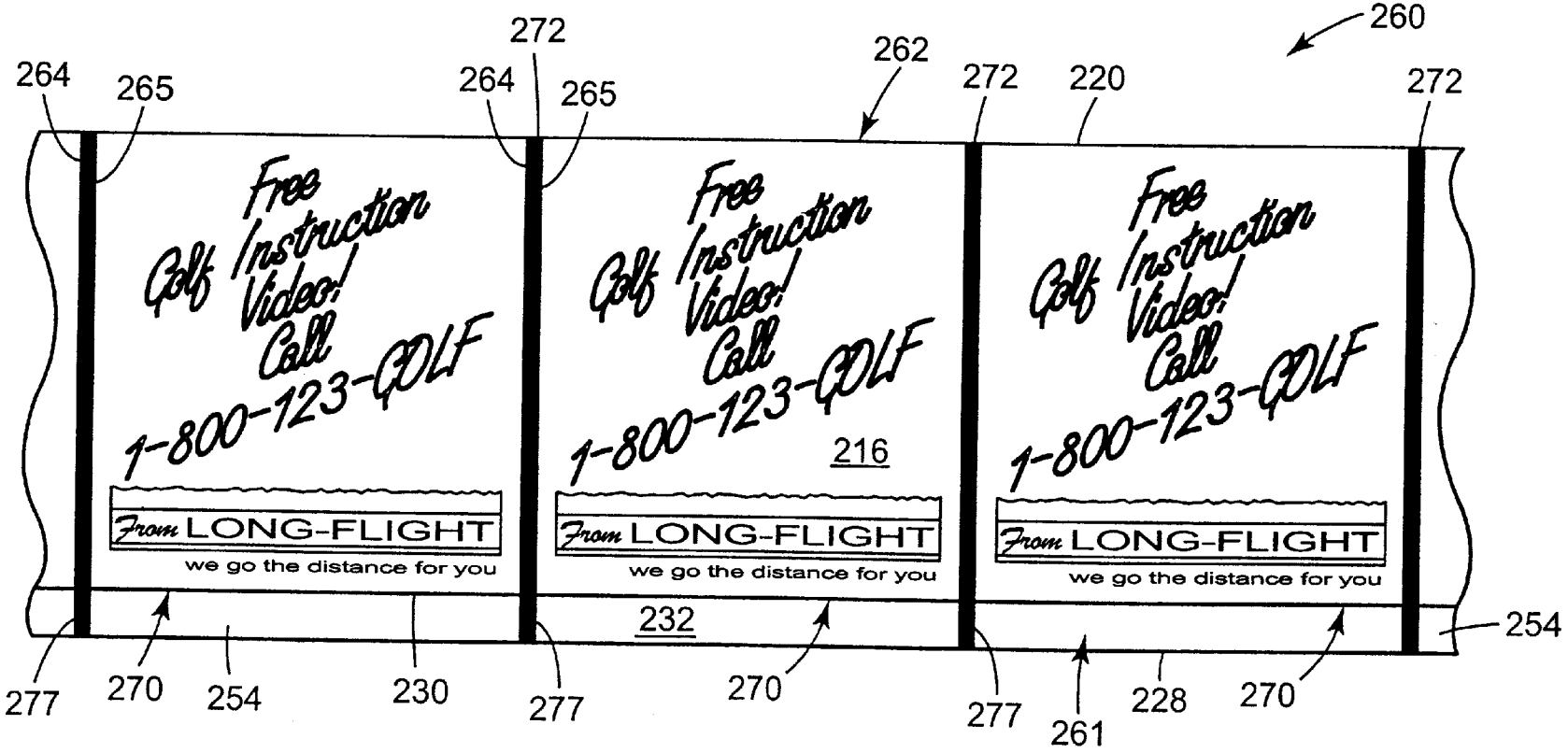
FIG. 19 is a plan view of a portion of the front face of a third alternative embodiment of the web strip assembly of the present invention.

Another embodiment of an inventive web strip assembly 260 is illustrated in FIG. 19. In this embodiment, the web strip 262 is initially generally identical to the previously described web strip 252, and the liner sheet 261 is generally identical to the liner sheet 251. Indeed, prior to the die cutting steps applied to the embodiments of FIGS. 18 and 19, the laminated web strip and liner sheet assemblies of each embodiment are identical. During the die cutting of the web strip 262 as it is carried on the liner sheet 261, a longitudinal edge portion of the web strip 262 is removed to expose the longitudinally extending edge portion 254 of the liner sheet 261 (adjacent the bottom edge 228 thereof). The bottom edge 230 of the web strip 262 is set off or spaced slightly laterally from the bottom edge 228 of the liner sheet 261 to define the edge portion 254. An additional lateral portion of the web strip 262 is removed between adjacent image patterns 214 to define the left and right side edges 264 and 265 of adjacent cut note sheets 270. This also exposes a lateral segment 272 of the liner sheet 261 between adjacent note sheets 270. Left and right edges 264 and 265 of adjacent note sheets 270 thus do not abut, but are separated by the width of the exposed lateral segment 272 of the first face 232 of the liner sheet 261 thereunder.

Eyemarks 277 are preferably aligned on the lateral segments 272 of the liner sheet 261 so that the eyemarks 277 are fully visible from the front face side of the web strip 262, as seen in FIG. 19. Although the eyemarks 277 are illustrated as in alignment with the exposed lateral segments 272 of the liner sheet 261, the eyemarks 277 can be located at different longitudinal locations along the liner sheets 261 (so long as one eyemark 277 is in registered alignment with one note sheet 270). In addition, because the eyemarks 277 can be printed on the longitudinal extending edge portion 254 of the liner sheet 261, the eyemarks 277 need not extend completely across the lateral width of the liner sheet 261, but need only be large enough to be optically detectable. If the color of the liner sheet 261 has a sufficient contrast to be optically detectable relative to the color of the note sheets 270, then no separate printed eyemarks may even be necessary.

In an alternative embodiment, the original laminate (web strip and liner sheet strip) is wide enough so that an edge section is removed along each longitudinal edge of the web strip, by defining a "ladder weed" of waste web strip material. The features of the embodiment illustrated in FIG. 19 can again be incorporated with the other inventive features disclosed herein, in any suitable combinations, to produce a useful intermediate roll, assembly, note strip or promotional assembly including a note strip.

Figure 20:
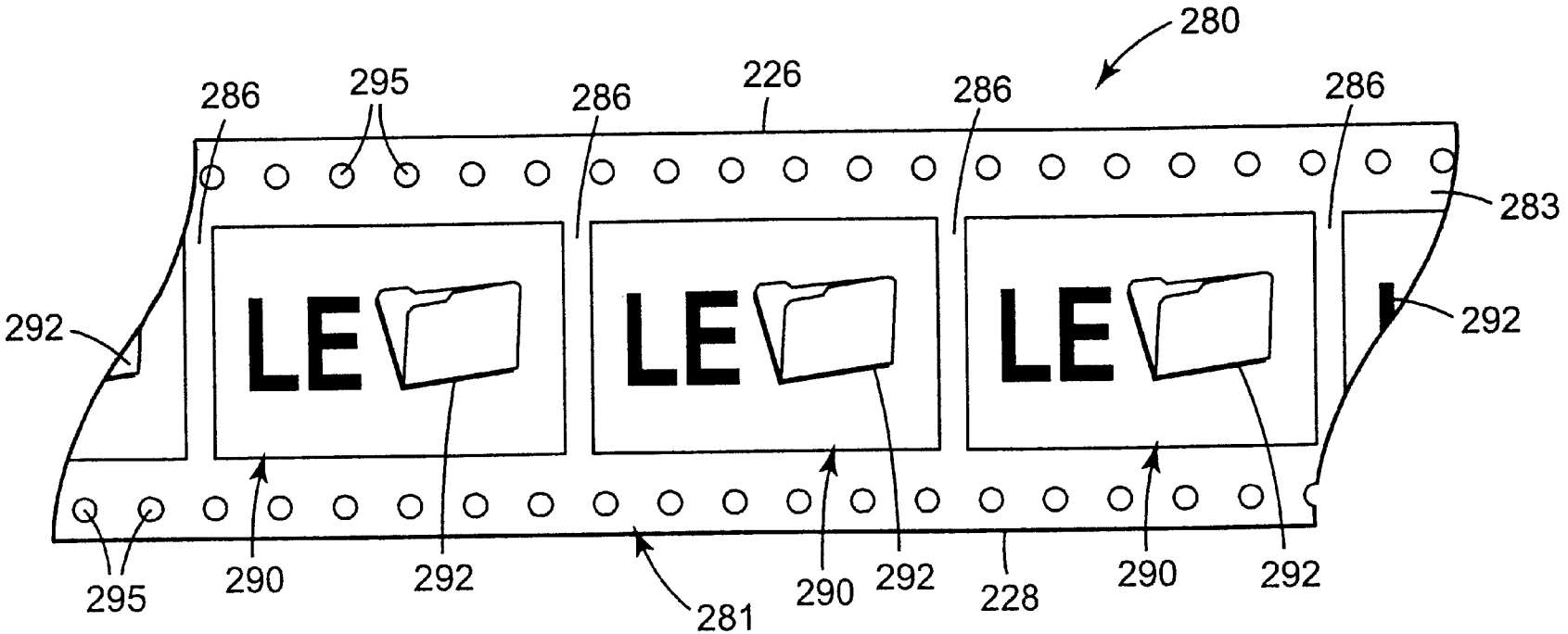
FIG. 20 is a plan view of a portion of the front face of a fourth alternative embodiment of the web strip assembly of the present invention.

FIG. 20 illustrates a web strip assembly 280 wherein a "ladder weed" of the web strip is die-cut and removed from the underlying liner sheet. In this arrangement, a liner sheet 281 has longitudinally extending edge portions 283 and 284 along top and longitudinal edges 226 and 228, respectively. An exposed lateral segment 286 is also die-cut from the web strip between adjacent note sheets 290. Each note sheet 290 bears a pattern of RPSA on its back face and an indicia pattern 292 on its front face, and is formed with one of the indicia pattern/adhesive pattern registration orientations disclosed herein. A plurality of longitudinally aligned perforations 295 extend along each of the edge portions 283 and 284. The perforations 295 in the liner sheet 281 are preferably die-cut at the same time the web strip is die-cut to form the note sheets 290. The perforations 295 are used for registration of the web strip assembly 280 during further processing, including the application of the note sheets 290 to workpieces such as direct-mail pieces. In this embodiment, registration eyemarks are unnecessary, since the perforations 295 provide a sufficient locational reference for further processing of the web strip assembly 280 and note sheet 290 application. Many conventional labeling machines and card feeders have a "pin-feed" drive mechanism for the label stock, which engages perforations like those illustrated in FIG. 20 for advancing the label stock to and away from the workpieces. A web strip assembly of this type may also be "fan-folded" (instead of rolled) for storage, shipment and application.

Figure 21:
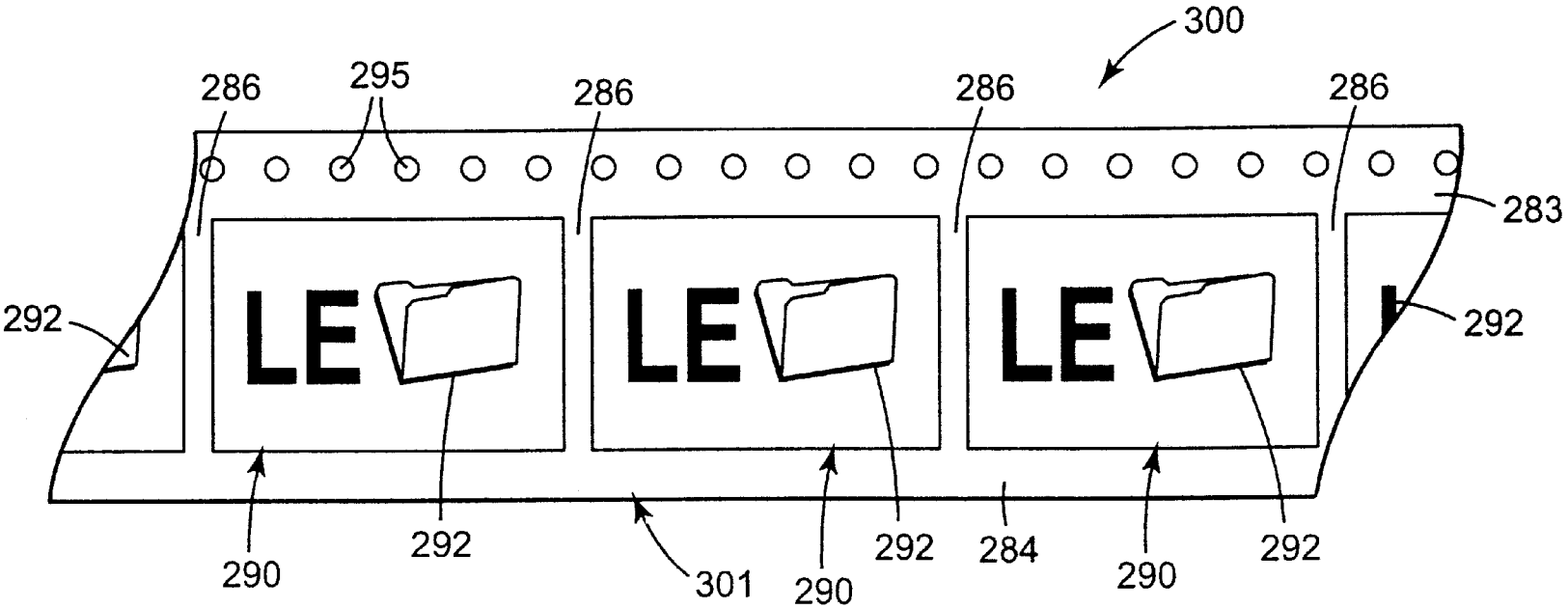
FIG. 21 is a plan view of a portion of the front face of a fifth alternative embodiment of the web strip assembly of the present invention.

FIG. 21 illustrates a web strip assembly 300 of the type illustrated in FIG. 20, except that perforations 295 are only made along one edge of the liner sheet—along the longitudinally extending edge portion 283 adjacent the top edge of a liner sheet 301. Some conventional labeling equipment and card feeders have a single-sided pin-feed mechanism for advancing label stock. In all other respects, the web strip assembly embodiment shown in FIG. 21 is the same as shown in FIG. 20. As with prior disclosed embodiments, the features of the embodiments of FIGS. 20 and 21 may be combined with any of the other inventive features disclosed herein to achieve an inventive combination, product or processing method.

The inventive article and method is disclosed in connection with various embodiments and examples herein. Each of these illustrations set forth different aspects, applications or steps and exemplify specific combinations of inventive features. The invention is not meant to be limited to the specific examples illustrated and described herein, but to all useful combinations of the inventive features in an article of manufacture or method of formation or use thereof. For example, while FIGS. 15, 16 and 17 illustrate an embodiment of a web sheet assembly having a liner, different liner, eyemark, adhesive pattern orientations and combinations thereof are possible. For instance, the adhesive pattern for the note sheets illustrated in FIG. 14 would suffice in the web strip assembly illustrated in FIGS. 15, 16 and 17. Three illustrative examples are presented below to further amplify the present invention and its relationship to prior art products and processes.

EXAMPLES

Illustrative Example 1 (Prior Art Roll Formation)

A wide web of bond, basis weight of 70 gsm, paper was coated with an adhesive release material, primer, and a plurality of bands of microsphere adhesive, as described in Silver U.S. Pat. No. 3,691,140. Upon drying, the web was rewound into a roll. The adhesive bands were 30 mm wide with the centerlines of adjacent bands separated by a distance of 6 inches (15.2 cm). The wide web was longitudinally split to form a plurality of 12 inch (30.4 cm) wide adhesive-coated webs. Each 12 inch adhesive-coated web was unwound, printed on both major faces (on its front face with rows of indicia patterns alternating in readability orientation laterally across the web (like in FIG. 2) and on its back face, with a registration eyemark pattern), longitudinally split through the centerline of each adhesive band into 3 inch (7.5 cm) wide small web strip rolls and rewound. Printing was at about 250 feet per minute (76 meters per minute), and was in registration with the adhesive bands. Half the rolls were rewound so that all rolls had the same printing orientation. The subsequent rewinding of the small web strip rolls was done at about 200 feet per minute (61 meters per minute). The total running time for 1000 meters of printed web, for rolls small web strip without rewinding, was about 13 minutes. The total running time for 1000 meters of printed web, for small web rolls requiring rewinding to correct their image pattern orientation, was about 29 minutes. The average labor content for printing and converting these small web strip rolls was 21 minutes (approximately 5 minutes per small web strip roll).

As so formed, each web strip roll has a 15 mm band of adhesive along its top edge. Following shipping, dirt was seen to accumulate along the top edges of the web strip rolls.

Subsequently, the small web strip rolls were unwound, mechanically cut to define note sheets, and the note sheets applied to printed pieces using the apparatus described in Miles et. al. U.S. patent application Ser. No. 08/729,780. This process speed was about 63 feet per minute (19 meters per minute), and yielded an average labor content of about 53 minutes for 1000 meters of small web strip roll. Thus, the total labor content to print, rewind, and apply note sheets from the small web strip rolls was about 57 minutes for 1000 meters of small web strip roll.

Example 2

A wide web of bond paper, basis weight of 70 gsm, was coated with an adhesive release material, primer, and a plurality of bands of microsphere adhesive, as described in Silver U.S. Pat. No. 3,691,140. Upon drying, the web was rewound into a roll. The adhesive bands were 0.5 inch (12.7 mm) wide with the centerlines of adjacent bands separated by a distance of 3 inches (7.6 cm). The wide web was longitudinally split to form a plurality of 12 inch (30.4 cm) wide adhesive-coated webs. Each 12 inch adhesive-coated web was unwound, printed on both major faces (on its front face with rows of indicia patterns of common readability orientation laterally across the web (like in FIG. 6) and on its back face with a registration eyemark pattern (like in FIG. 7)), longitudinally split into 3 inch (7.5 cm) wide small web strip rolls and rewound. The edge of the adhesive band was aligned adjacent to one edge of the web strip roll, and averaged 2 mm in spacing from that nearest edge. Printing was at about 250 feet per minute (76 meters per minute). The subsequent rewinding of the small web strip rolls was done at about 200 feet per minute (61 meters per minute). The total running time for 1000 meters of printed web was about 13 minutes (about 3 minutes per small web strip roll). The average labor content for printing and converting the web strip rolls of Example 2 saved about 38 percent of the labor content required to produce the small web strip rolls of Example 1.

No dirt was observed on the edges of the small web strip rolls.

Subsequently, the small web strip rolls were unwound, mechanically cut to define note sheets, and the note sheets applied to printed pieces using the apparatus described in Miles et al. U.S. patent application Ser. No. 08/729,780. This process speed was about 63 feet per minute (19 meters per minute), and yielded an average labor content of about 53 minutes for 1000 meters of small web strip roll. Thus, the total labor content to print and apply sheets from the small web strip rolls was about 55 minutes for 1000 meters of small web strip roll. The average labor content for printing, converting, and applying note sheets from the small web strip rolls of Example 2 saved about 2 percent of the labor content of the rolls produced in Example 1.

Example 3

A wide web of bond paper, basis weight of 70 gsm, was coated with an adhesive release material, primer and a plurality of bands of microsphere adhesive, as described in Silver U.S. Pat. No. 3,691,140. Upon drying, the web was rewound into a roll. The adhesive bands were 30 mm wide with the centerlines of adjacent bands separated by a distance of 3 inches (7.6 cm). The wide web was longitudinally split to form a plurality of 12 inch (30.4 cm) wide adhesive-coated webs. Each 12 inch web was unwound, printed on its front face with rows of indicia patterns of common. readability (like in FIG. 6) and on its back face with product source indicia patterns (e.g., Post-it® Products"), split into 3 inch (7.6 cm) wide small web strip rolls and rewound. The web was split to asymmetrically divide each adhesive band into a wide band (approximately 28 mm) adjacent the top edge of one web strip and a narrow band (approximately 2 mm) adjacent the bottom edge of a laterally adjacent web strip. Printing was at about 250 feet per minute (76 meters per minute).

A second wide web of bond paper was prepared and longitudinally split (in multiple web splitting steps) into small liner sheet strips 3 inches (7.5 cm) wide. Each liner sheet strip was printed on one side with an eyemark pattern (e.g., as in FIG. 15) and an adhesive release material was applied over the eyemarks. Each printed liner sheet strip was then laminated to the back of one of the web strips, using the adhesive on that web strip, to define a web strip assembly.

Note sheets were formed on the assembly by kiss-cut die cutting the web strip in a ladder matrix, and then removing the "ladder weed" matrix between sheets. The resultant note sheet size was about 2⅞ inch×3 inch (7.3 cm×7.5 cm). The assembly was then wound into small web strip assembly rolls.

Subsequently, the small web strip assembly rolls were unwound, and the note sheets separated from the liner sheet and applied to printed pieces using a direct-apply labeler, such as a Model Q60B labeler, available from QLS Labeling Systems, Eastlake, Ohio. This process speed was about 63 feet per minute (19 meters per minute), and yielded an average labor content of about 53 minutes for 1000 meters of small web strip assembly roll. The total labor content to print and apply note sheets from the small web strip assembly rolls was about 57 minutes for 1000 meters of small web strip assembly roll.

Similarly, the small web strip assembly rolls were found to dispense easily from a blow-on labeling apparatus, such as a Model 2111ST labeler, available from Label-Aire Incorporated, Fullerton, Calif.

Although the present invention has been described with reference to preferred embodiments, workers skilled in the art will recognize that changes may be made in form and detail without departing from the spirit and scope of the invention. For example, while the indicia patterns printed on the front face of the web have common readability orientation, they do not necessarily need to be identical indicia patterns in each row, or even from row to row. Further, the lateral cut across a linerless web strip does not necessarily have to be normal to the longitudinal extent of the web strip. The cut may be wavy or otherwise nonlinear. In addition, in a web strip assembly having a liner sheet, note sheets of any shape are attainable by kiss-cut die cutting the web strip (e.g., hearts, teddy bear symbols, shamrocks, etc.). Web strips or web strip assemblies formed by the present invention may be rolled for storage, shipment and application, or may be placed in a fan-fold alignment for further use.

What is claimed is:

1. In a web of sheet material having a front major face and a back, opposite major face, the improvement which comprises:

the front face having a plurality of longitudinal rows of indicia patterns disposed thereon, each row having a longitudinal row top edge and a longitudinal row bottom edge, and each row being formed from a plurality of indicia pattern segments, each pattern segment having a segment top edge coterminous with its respective top row edge and a segment bottom edge coterminous with its respective row bottom edge, and each pattern segment having a left side edge and a right side edge;

the back face having a plurality of longitudinally disposed patterns of repositionable pressure sensitive adhesive thereon, each adhesive pattern having a longitudinal adhesive top edge and a longitudinal adhesive bottom edge, the adhesive top edge of each adhesive pattern being aligned adjacent and opposite to the row top edge of one of the rows of indicia patterns; and each longitudinal row of indicia patterns having a common orientation for readability, the orientation for the readability being further coordinated with the orientation of the patterns of repositionable pressure sensitive adhesive to result in a predetermined relation between the orientation of the readability of the indicia and the orientation of the adhesive.

2. The web of sheet material of claim 1 wherein each pattern segment is identical.

3. The web of sheet material of claim 1, and further comprising:

a longitudinal row separation line defined between adjacent rows.

4. The web of sheet material of claim 3 wherein each row separation line is co-linear with the adhesive top edge of one of the rows.

5. The web of sheet material of claim 3 wherein each row separation line is spaced above and away from the adhesive top edge of an adhesive pattern along the row top edge of one of the rows.

6. The web of sheet material of claim 3 wherein each row separation line is aligned within one of the adhesive patterns.

7. The web of sheet material of claim 6 wherein the row separation line extending through each of the respective adhesive patterns asymmetrically divides that adhesive pattern.

8. The web of sheet material of claim 1 wherein each adhesive top edge on the back face of the sheet material is co-linear with a respective one of the row top edges on the front face of the sheet material.

9. The web of sheet material of claim 1 wherein the web is wound about a laterally disposed axis into a roll.

10. The web of sheet material of claim 1 wherein the back face has a registration indicia pattern printed thereon which is aligned in registration with the indicia patterns on the front face of the web of sheet material.

11. The web of sheet material of claim 10 therein the registration indicia pattern is a plurality of laterally disposed eyemarks printed on the back face of the web of sheet material, the eyemarks being spaced longitudinally to place at least a portion of each eyemark in aligned registration with an oppositely respective one of the indicia pattern segments on the front face of the web of sheet material.

12. The web of sheet material of claim 1, and further comprising:

a liner sheet having a first major face and a second, opposite major face, and the first face of the liner sheet being laminated to the back face of the web of sheet material via the repositionable pressure sensitive adhesive thereon.

13. The web of sheet material of claim 12, and further comprising:

a plurality of registration eyemarks printed on the first face of the liner sheet, at least a portion of each eyemark in oppositely aligned registration with a respective one of the indicia pattern segments on the front face of the web of sheet material.

14. The web of sheet material of claim 13 wherein the web of sheet material is sufficiently translucent that the registration eyemarks are detectable therethrough from the front face of the web of sheet material.

15. The web of sheet material of claim 12 wherein the first face of the liner sheet has an adhesive release layer coating thereon.

16. A web strip assembly comprising:

a note sheet strip having a front major face, a back, opposite major face, a longitudinally extending top edge and a longitudinally extending bottom edge, the front face having a plurality of longitudinally aligned indicia pattern segments disposed thereon, each pattern segment having a longitudinally extending segment top edge, a longitudinally extending segment bottom edge, a laterally disposed left side edge and a laterally disposed right side edge, the back face having a first longitudinally aligned pattern of repositionable pressure sensitive adhesive thereon, the first adhesive pattern having a longitudinal adhesive top edge and a longitudinal adhesive bottom edge, the adhesive top edge being aligned adjacent and opposite to the segment top edges of the indicia pattern segments;

each longitudinal row of indicia patterns having a common orientation for readability, the orientation for the readability being further coordinated with the orientation of the patterns of repositionable pressure sensitive adhesive to result in a predetermined relation between the orientation of the readability of the indicia and the orientation of the adhesive; and a liner sheet strip having a first major face, a second, opposite major face, a longitudinally extending top edge and a longitudinally extending bottom edge, the first face of the liner sheet strip being laminated to the back face of the note sheet strip via the repositionable pressure sensitive adhesive thereon, and the top edges of the note sheet strip and liner sheet strip being coterminous and the bottom edges of the note sheet strip and liner sheet strip being coterminous.

17. The web strip assembly of claim 16, and further comprising:

a plurality of registration eyemarks printed on the first face of the liner sheet, with each eyemark being in oppositely aligned registration with a respective one of the indicia pattern segments on the front face of the note sheet strip.

18. The web strip assembly of claim 17 wherein the note strip sheet has a plurality of lateral cuts therethrough to form a plurality of longitudinally disposed discrete note sheets adhered to the liner sheet strip, each note sheet bearing one of the indicia pattern segments thereon.

19. The web strip assembly of claim 17 wherein one of the bottom or top edges of the liner sheet strip extends laterally beyond its respective edge of the note strip sheet to define a longitudinal liner edge portion.

20. The web strip assembly of claim 19 wherein at least a portion of each registration mark is on the longitudinal liner edge portion.

21. The web strip assembly of claim 17 wherein the note sheet strip is sufficiently translucent that the registration eyemarks are detectable therethrough from the front face of the note sheet strip.

22. The web strip assembly of claim 16 wherein a lateral section of the note sheet strip is removed between adjacent indicia pattern segments to form a plurality of longitudinally disposed and discrete note sheets adhered to the liner sheet strip, each note sheet bearing one of the indicia pattern segments thereon, and adjacent note sheets having a lateral edge portion of the first face of the liner strip sheet exposed therebetween.

23. The web strip assembly of claim 22 wherein the exposed lateral edge portion of the first face of the liner strip sheet and the front faces of the adjacent note sheets have a detectably visible contrast.

24. The web strip of claim 16, and further comprising:

the back face of the note sheet strip having a second longitudinally aligned pattern of repositionable pressure sensitive adhesive thereon for laminating the liner sheet strip to the note sheet strip, the second adhesive pattern having a longitudinal adhesive top edge and a longitudinal adhesive bottom edge, the adhesive bottom edge being aligned adjacent and opposite to the segment bottom edges of the indicia pattern segments.

* * * * *

UNITED STATES PATENT AND TRADEMARK OFFICE

CERTIFICATE OF CORRECTION

PATENT NO. : 6,268,032 B1
DATED : July 31, 2001
INVENTOR(S) : Timothy A. Mertens et al.

It is certified that error appears in the above-identified patent and that said Letters Patent is hereby corrected as shown below:

Title page,
Item [74], *Attorney, Agent, or Firm*, delete “Hakama”, insert -- Hakamaki --

Column 3,
Line 29, delete “08/636,615”, insert -- 08/636,618 --
Line 40, after “present” insert -- invention --
Line 62, delete “by”, insert -- be --

Column 6,
Line 63, after “applied” insert -- to --

Column 9,
Line 45, delete “had”, insert -- has --

Column 10,
Line 1, delete “atop”, insert -- a top --

Column 11,
Line 7, delete “therein”, insert -- wherein --

Column 15,
Line 60, delete “eyemarks”, insert -- eyemark --

Column 19,
Line 29, after “Products” delete -- """ --

Signed and Sealed this

Tenth Day of September, 2002

*Attest:*

*Attesting Officer*

JAMES E. ROGAN
*Director of the United States Patent and Trademark Office*